US009858733B2

(12) United States Patent
Ohno et al.

(10) Patent No.: US 9,858,733 B2
(45) Date of Patent: Jan. 2, 2018

(54) VEHICLE DIAGNOSTIC DATA COLLECTING APPARATUS, VEHICLE DIAGNOSTIC DATA COLLECTING METHOD, VEHICLE DIAGNOSTIC MACHINE, AND VEHICLE DIAGNOSING METHOD

(71) Applicant: HONDA MOTOR CO., LTD., Tokyo (JP)

(72) Inventors: Tetsuya Ohno, Tokyo (JP); Makoto Uchida, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/723,671

(22) Filed: May 28, 2015

(65) Prior Publication Data

US 2015/0348339 A1 Dec. 3, 2015

(30) Foreign Application Priority Data

Jun. 3, 2014 (JP) ..... 2014-114864
Jun. 3, 2014 (JP) ..... 2014-114870

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01); *G07C 2205/02* (2013.01)

(58) Field of Classification Search
None
See application file for complete search history.

(56) References Cited

U.S. PATENT DOCUMENTS 5,491,631 A 2/1996 Shirane et al.
2002/0002430 A1 1/2002 Nada
2003/0050747 A1 3/2003 Kamiya
2004/0172177 A1 9/2004 Nagai et al.
2007/0030844 A1 2/2007 Fukuta et al.
(Continued)

FOREIGN PATENT DOCUMENTS

JP 62-142849 A 6/1987
JP 05-171998 A 7/1993
(Continued)

OTHER PUBLICATIONS

Japanese Notice of Allowance issued in corresponding Japanese Patent Application No. 2015-245385 dated Jul. 4, 2017.
(Continued)

*Primary Examiner* — Krishnan Ramesh
(74) *Attorney, Agent, or Firm* — Squire Patton Boggs (US) LLP

(57) ABSTRACT

A data collecting apparatus sets types of target ECUs, and stores, in a storage unit, driving parameter data items, which are capable of being output by a plurality of ECUs, in association with IDs of the plurality of ECUs. Subsequently, for each of the aforementioned types, a query is made to a vehicle as to whether an installed ECU exists, and the installed ECU is identified as a target ECU. Thereafter, based on the ID of the installed ECU, driving parameter data items capable of being output by the installed ECU that was identified as the target ECU are set as collection items.

6 Claims, 12 Drawing Sheets

(56) References Cited

U.S. PATENT DOCUMENTS

| | | | | |
|---|---|---|---|---|
| 2009/0299566 | A1* | 12/2009 | Tanigawa | G07C 5/008 701/31.4 |
| 2010/0205450 | A1 | 8/2010 | Sarnacke et al. | |
| 2012/0197481 | A1* | 8/2012 | Takeda | B60W 50/0205 701/31.4 |
| 2013/0311526 | A1 | 11/2013 | Uesaka | |
| 2014/0371977 | A1 | 12/2014 | Sumi et al. | |

FOREIGN PATENT DOCUMENTS

| | | | |
|---|---|---|---|
| JP | 09-210867 | A | 8/1997 |
| JP | 2001-317403 | A | 11/2001 |
| JP | 2003-114943 | A | 4/2003 |
| JP | 2006-505792 | A | 2/2006 |
| JP | 2006-291730 | A | 10/2006 |
| JP | 2007-038921 | A | 2/2007 |
| JP | 2008-070133 | A | 3/2008 |
| JP | 2009-293951 | A | 12/2009 |
| JP | 2010-202127 | A | 9/2010 |
| JP | 2012-168024 | A | 9/2012 |

OTHER PUBLICATIONS

Japanese Office Action Notification of Reasons for Refusal application No. 2014-114870 dated Aug. 22, 2017.

* cited by examiner

FIG. 7

| | DIAGNOSTIC TARGET SITE | ENGINE | TRANSMISSION | BATTERY | TRACTION MOTOR | ・・・ |
|---|---|---|---|---|---|---|
| | TYPE OF TARGET ECU | ENGINE ECU | TRANSMISSION ECU | BATTERY ECU | MOTOR ECU | ・・・ |
| | ID OF TARGET ECU | 07, 0E, 10, 11 | 0E, 1D, 1E | 03, 05 | 04, 05 | ・・・ |
| | VIN ACQUISITION FILE Fvin | VIN.unt | | | | |
| DATA ACQUISITION FILE Fdata | GASOLINE VEHICLE / CNG VEHICLE / FFV | Gasoline&CNG.mam | Mission.mam | – | – | ・・・ |
| | HYBRID VEHICLE | | | BAT.mam | MOT.mam | ・・・ |
| | DIESEL VEHICLE | Diesel.mam | | – | – | ・・・ |
| | EV | MG_EV.mam | – | BAT.mam | MOT.mam | ・・・ |
| | ・<br>・<br>・ | ・<br>・<br>・ | ・<br>・<br>・ | ・<br>・<br>・ | ・<br>・<br>・ | ・<br>・<br>・ |

FIG. 11

56

300

F-CAN ECU SETTINGS: GasolineCNG 320 302

| | 310 TRANSMISSION PERIOD | 312 CATEGORY | 314 DATA ITEMS | 316 DESCRIPTION 1 | 318 UNITS |
|---|---|---|---|---|---|
| ☑ | 500ms | Gasoline | ISINFBATCH | I/S PROHIBITED (BATTERY CHARGING CONDITION) | ** |
| ☑ | 500ms | Gasoline | ISINFBADBT | I/S PROHIBITED (BATTERY DETERIORATED) | ** |
| ☑ | 500ms | Gasoline | ISINHHDOP | I/S PROHIBITED (ENGINE HOOD OPEN) | ** |
| ☑ | 500ms | Gasoline | VSV | EVAP CVS SOL. V | ** |
| ☑ | 500ms | Gasoline | EVAPVP | TANK INTERNAL PRESSURE SENSOR (DETAILS) | Pa |
| ☑ | 500ms | Gasoline | LIDMSW | OPENED/CLOSED CONDITION OF LID | ** |
| ☑ | 500ms | Gasoline | PATNKSLD | SEALED TANK INTERNAL PRESSURE | kPa |
| ☑ | 500ms | Gasoline | TF2PHY | FUEL TEMPERATURE (CNG) | ℃ |
| ☑ | 500ms | Gasoline | PFOPHY | TANK INTERNAL PRESSURE (CNG) | kPa |
| ☑ | 500ms | Gasoline | TFOPHY | TANK TEMPERATURE (CNG) | ℃ |
| ☐ | 500ms | Gasoline | ABSTH | THROTTLE TEMPERATURE SENSOR | V |
| ☐ | 500ms | Gasoline | TW | COOLANT TEMPERATURE SENSOR | V |
| ☐ | 500ms | Gasoline | TA | INTAKE TEMPERATURE SENSOR | V |
| ☐ | 500ms | Gasoline | PB | INTAKE PRESSURE SENSOR | V |
| ☐ | 500ms | Gasoline | PA | ATMOSPHERIC PRESSURE SENSOR | V |
| ☐ | 500ms | Gasoline | CLV | ENGINE LOAD | % |

VEHICLE DIAGNOSTIC DATA COLLECTING APPARATUS, VEHICLE DIAGNOSTIC DATA COLLECTING METHOD, VEHICLE DIAGNOSTIC MACHINE, AND VEHICLE DIAGNOSING METHOD

CROSS-REFERENCE TO RELATED APPLICATIONS

This application is based upon and claims the benefit of priority from Japanese Patent Applications No. 2014-114864 filed on Jun. 3, 2014 and No. 2014-114870 filed on Jun. 3, 2014, the contents all of which are incorporated herein by reference.

BACKGROUND OF THE INVENTION

Field of the Invention:

The present invention relates to a vehicle diagnostic data collecting apparatus, a vehicle diagnostic data collecting method, a vehicle diagnostic machine, and a vehicle diagnosing method.

Description of the Related Art:

In the event that abnormal conditions are generated during driving of a vehicle, notification to the driver is performed through warnings by illuminating a warning lamp or the like that is provided on an instrument panel. Together with such abnormal conditions or the warnings that accompany the same, the user brings the vehicle to a dealer or a repair facility where diagnostic operations or repairs on the vehicle are carried out.

An operator (a technician or the like) in charge of the repairs connects a fault diagnosis device to an electronic control unit (hereinafter referred to as an "ECU") of the faulty vehicle, and by reading out information that is stored in the ECU concerning fault codes, etc., at the time that the fault occurred, abnormal systems (electrical circuits in which a fault is taking place) can be identified relatively easily. This type of fault diagnostic device is widely known, and for example, is disclosed in U.S. Pat. No. 5,491,631.

However, in spite of the fact that various complaints from the user concerning faulty conditions may exist, cases occur in which there is no record of failure codes for such abnormalities. Further, cases occur (so-called problematic repairs) in which the faulty condition corresponding to such complaints cannot be reproduced even though the technician handling the repair attempts to do so, and hence repair of the vehicle is quite difficult to carry out.

With respect to such problematic repairs, for example, as disclosed in Japanese Laid-Open Patent Publication No. 2008-070133 (hereinafter referred to as "JP2008-070133A") and U.S. Patent Application Publication No. 2014/0371977 (hereinafter referred to as "US2014/0371977A1"), a large capacity storage device is temporarily attached to an ECU of the subject vehicle, and the user is made to drive the vehicle over several days. In addition, data (driving parameter data) required for the fault diagnosis are collected and accumulated in the storage device, and detailed diagnostics are carried out by investigating the collected data using a failure diagnostic device or a failure analysis device.

According to JP2008-070133A, in order to automatically perform collection and output of data, ON/OFF operations of an ignition key switch 51 and ON/OFF operations of a USB power source caused by connection to a PC are detected, and collection and output of data are carried out (abstract). In JP2008-070133A, by a setting unit 18 that serves as a setting means, settings are made beforehand in a data collecting unit 15 as to which types of control data are selected and accumulated. The setting unit 18 includes an input/output operating unit, and for performing the setting operation with the setting unit 18, a model table 19 is prepared beforehand. Additionally, when an operator inputs the vehicle type of the vehicle in which a vehicle data collecting apparatus 1 is installed, from the input/output operating unit of the setting unit 18, types of control data (parameter IDs, etc.) to be collected, which are grouped and stored beforehand in the model table 19, are read out by the setting unit 18 and are set in the data collecting unit 15 ([0034]).

According to US2014/0371977A1, an operator inputs data collecting conditions (paragraph [0058]). Among the data collecting conditions, there are included a vehicle type, a vehicle model, a destination, specifications, a network type, an input channel number used by a data collecting apparatus 18, and the baud rate of the subject network 24 (paragraph [0063]). Furthermore, among the data collecting conditions, there may also be included content (items) of driving parameter data D, an ECU 20 (target ECU 20tar) that requests the data D, a time (continuous data acquiring time) for continuously acquiring the data D, a period (continuous data acquiring period) for continuously acquiring the data D, and a total time (total data collecting time) required to collect the data D (paragraph [0064]).

SUMMARY OF THE INVENTION

As described above, according to JP2008-070133A and US2014/0371977A1, it is necessary for an operator to set the type, etc., of driving parameter data to be collected. Therefore, there is a concern that a great deal of effort (man-hour) is needed for this kind of setting operation, and there also is a concern that incorrect settings may occur due to human error.

The present invention has been devised taking into consideration the above problems. An object of the present invention is to provide a vehicle diagnostic data collecting apparatus and a vehicle diagnostic data collecting method, together with a vehicle diagnostic machine and a vehicle diagnosing method, which enable at least one of reducing the number of steps (man-hour) required for making data collection settings, and preventing erroneous data collection settings.

A vehicle diagnostic data collecting apparatus according to the present invention is characterized in that, in a state of being connected detachably from the exterior to an in-vehicle network having a plurality of ECUs, a data request signal for requesting driving parameter data indicative of operating states of respective components of a vehicle is transmitted to at least one target electronic control unit of the plurality of ECUs, and the driving parameter data corresponding to the data request signal is received and stored in a data storage unit. The data collecting apparatus includes a type setting unit that sets a type of the target ECU, a data item storage unit that stores items of the driving parameter data in association with identifying information of the plurality of ECUs, the driving parameter data items being capable of being output by each of the plurality of ECUs, a collection item setting unit that queries the vehicle as to whether or not an installed ECU exists, and identifies the installed ECU as the target ECU for each type of target ECU set by the type setting unit, reads out the driving parameter data items capable of being output by the installed ECU that was identified as the target ECU, from the data item storage unit, based on identifying information of the installed ECU, and sets the driving parameter data items as collection items, and a data collecting manager that transmits to the target ECU the data request signal for requesting the driving parameter data corresponding to the collection items, and receives and stores in the data storage unit the driving parameter data corresponding to the data request signal.

According to the present invention, since the data collecting apparatus carries out at least part of the settings for the collection items, it is possible to reduce the effort of the worker associated with setting of the collection items. Further, since an installed ECU notified from the vehicle is identified as a target ECU, together with items corresponding to the target ECU being set as the collection items, it is possible to prevent human error of the operator associated with setting of the collection items.

The collection item setting unit may query the vehicle as to whether or not the installed ECU exists for each type of target ECU set by the type setting unit, and set the collection items in response to an initial on operation of a starting switch in a state in which the data collecting apparatus is connected to the vehicle. Subsequently, if the starting switch is turned off and thereafter turned on again, the data collecting manager may initiate transmission of the data request signal and storage of the driving parameter data.

According to this feature, at least part of the settings of the collection items and starting collection of the driving parameter data can be carried out by connection of the data collecting apparatus with respect to the in-vehicle network, and by operation of the starting switch. Consequently, with a simple operation, the operator can perform at least part of the settings of the collection items and starting collection of the driving parameter data.

If the connection of the data collecting apparatus with respect to the in-vehicle network has been released once, then responsive to an initial on operation of the starting switch after the data collecting apparatus has been connected to a new in-vehicle network, the new in-vehicle network may be queried as to whether or not the installed ECU exists for each type of target ECU set by the type setting unit, and new collection items may be set. According to this feature, the diagnostic target vehicle can easily be changed, simply by removing the data collecting apparatus from one vehicle (first vehicle) and attaching it to another vehicle (second vehicle).

The connection between the data collecting apparatus and the in-vehicle network may be carried out through a data link connector of the vehicle, and the data collecting apparatus may be started by supply of electric power thereto from a vehicle-mounted power supply through the data link connector. According to this feature, the activation timing at which the data collecting apparatus is activated can coincide with the time of connection to the data link connector. Consequently, restarting of the data collecting apparatus can be carried out by detaching and thereafter attaching the data collecting apparatus with respect to the data link connector for the purpose of changing the diagnostic target vehicle, and it is possible to easily operate the data collecting apparatus after the diagnostic target vehicle has been changed.

The type setting unit may integrate the plurality of vehicle types, and may classify the ECUs that are installed in each vehicle type, based on type of function of each of the ECUs. According to this feature, while achieving a reduction in burden of the input operation by the operator or preventing input errors, the computational load in the data collecting apparatus and the effort or number of steps imposed on the operator can be reduced.

A vehicle diagnostic data collecting method according to the present invention is characterized by using a data collecting apparatus in which, in a state of being connected detachably from the exterior to an in-vehicle network having a plurality of ECUs, a data request signal for requesting driving parameter data indicative of operating states of respective components of a vehicle is transmitted to at least one target ECU of the plurality of ECUs, and the driving parameter data corresponding to the data request signal is received and stored in a storage unit. The data collecting apparatus performs a type setting process for setting a type of the target ECU, a storing process for storing, in the storage unit, items of the driving parameter data in association with identifying information of the plurality of ECUs, the driving parameter data items being capable of being output by each of the plurality of ECUs, a collection item setting process for querying the vehicle as to whether or not an installed ECU exists, to thereby identify the installed ECU as the target ECU for each type of target ECU set by the type setting process, reading out the driving parameter data items capable of being output by the installed ECU that was identified as the target ECU, from the storage unit, based on identifying information of the installed ECU, and setting the driving parameter data items as collection items, and a data collecting process for transmitting to the target ECU the data request signal for requesting the driving parameter data corresponding to the collection items, and receiving and storing in the storage unit the driving parameter data corresponding to the data request signal.

A vehicle diagnostic machine according to the present invention includes a data collecting apparatus, which is connected from the exterior to an in-vehicle network having a plurality of ECUs, transmits a data request signal for requesting driving parameter data indicative of operating states of respective components of a vehicle to at least one target ECU of the plurality of ECUs, and receives and stores the driving parameter data corresponding to the data request signal in a storage unit, and a diagnostic device for performing a diagnosis of the vehicle based on the driving parameter data acquired by the data collecting apparatus. The data collecting apparatus includes a vehicle identifying information acquiring unit that acquires vehicle identifying information from the vehicle, a collection item setting unit that queries the vehicle about identifying information of the target ECU, determines items of the driving parameter data that are capable of being output by the target ECU, based on the identifying information of the target ECU, and sets the driving parameter data items as collection items, and a data collecting manager that transmits to the target ECU the data request signal for requesting the driving parameter data corresponding to the collection items, and receives and stores in the storage unit the driving parameter data corresponding to the data request signal. The diagnostic device acquires the vehicle identifying information, the collection items, and the driving parameter data from the data collecting apparatus, specifies output capable items of the driving parameter data, which are possessed by an installed ECU corresponding to the vehicle identifying information, compares the output capable items possessed by the installed ECU with the collection items that are collected from the target ECU, and in the case that a missing item for which the driving parameter data are not collected exists within the collection items that have actually been collected, with respect to the output capable items possessed by the installed ECU, determines that there is a possibility for occurrence of a fault concerning the missing item.

According to the present invention, with respect to output capable items possessed by an installed ECU that corresponds to the vehicle identifying information, in the case that a missing item for which the driving parameter data are not collected exists within the collection items that have actually been collected, it is determined that there is a possibility for occurrence of a fault concerning the missing item. Consequently, a site that has the possibility of generating a fault can easily be specified. For example, it can be presumed that a communications error has occurred in relation to the ECU corresponding to the missing item.

Further, the output capable items possessed by the installed ECU are first specified (or limited) based on the vehicle identifying information, and then are compared with the collection items. Therefore, among the output capable items possessed by the installed ECU, the scope of what is compared with the collection items can be narrowed, and thus it is possible to reduce the processing load of the diagnostic machine as well as the effort of the operator associated therewith.

The vehicle diagnostic machine may include a type setting unit that sets a type of the target ECU, a data item storage unit that stores items of the driving parameter data in association with identifying information of the plurality of ECUs, the driving parameter data items being capable of being output by each of the plurality of ECUs, and a target ECU identifying unit that queries the vehicle as to whether or not an installed ECU exists, and identifies the installed ECU as the target ECU for each type of target ECU set by the type setting unit.

According to this feature, since the data collecting apparatus carries out at least part of the settings for the collection items, it is possible to reduce the effort of the worker associated with setting of the collection items. Further, since an installed ECU notified from the vehicle is identified as a target ECU, together with items corresponding to the target ECU being set as the collection items, it is possible to prevent human error of the operator associated with setting of the collection items.

A vehicle diagnosing method according to the present invention is characterized by using a vehicle diagnostic machine, which is connected externally to an in-vehicle network having a plurality of ECUs, acquires driving parameter data indicative of operating states of respective components of a vehicle from at least one target ECU of the plurality of ECUs, and carries out a diagnosis of the vehicle based on the driving parameter data that are acquired. The vehicle diagnostic machine acquires vehicle identifying information from the vehicle, queries the vehicle about identifying information of the target ECU, determines items of the driving parameter data that are capable of being output by the target ECU, based on identifying information of the target ECU, and sets the driving parameter data items as collection items. In addition, the vehicle diagnostic machine transmits to the target ECU a data request signal for requesting the driving parameter data corresponding to the collection items, and receives and stores in a storage unit the driving parameter data corresponding to the data request signal. The vehicle diagnostic machine also specifies output capable items of the driving parameter data, which are possessed by an installed ECU corresponding to the vehicle identifying information, and compares the output capable items possessed by the installed ECU with the collection items that are collected from the target ECU. In the case that a missing item for which the driving parameter data are not collected exists within the collection items that have actually been collected, with respect to the output capable items possessed by the installed ECU, the vehicle diagnostic machine determines that there is a possibility for occurrence of a fault concerning the missing item.

A vehicle diagnostic machine according to the present invention is connected externally to an in-vehicle network having a plurality of ECUs, and acquires driving parameter data indicative of operating states of respective components of a vehicle from at least one target ECU of the plurality of ECUs, and carries out a diagnosis of the vehicle based on the driving parameter data that are acquired. The vehicle diagnostic machine specifies output capable items of the driving parameter data, which are possessed by an installed ECU corresponding to vehicle identifying information, and compares the output capable items possessed by the installed ECU with collection items that are collected from the target ECU. Further, in the case that a missing item for which the driving parameter data are not collected exists within the collection items that have actually been collected, with respect to the output capable items possessed by the installed ECU, the vehicle diagnostic machine determines that there is a possibility for occurrence of a fault concerning the missing item.

The above and other objects, features and advantages of the present invention will become more apparent from the following description when taken in conjunction with the accompanying drawings, in which a preferred embodiment of the present invention is shown by way of illustrative example.

BRIEF DESCRIPTION OF THE DRAWINGS

FIG. 7 is a view showing by way of example various types of information (identifying information (ID) of a target ECU, etc.) corresponding to the type of diagnostic target site or target ECU;

FIG. 11 is a view showing by way of example a display screen of the diagnostic machine main body, showing results of a comparison between collection items and output capable items.

DESCRIPTION OF THE PREFERRED EMBODIMENTS

A. Embodiment

[1. Configuration]

(1-1. Overall Configuration)

Figure 1:
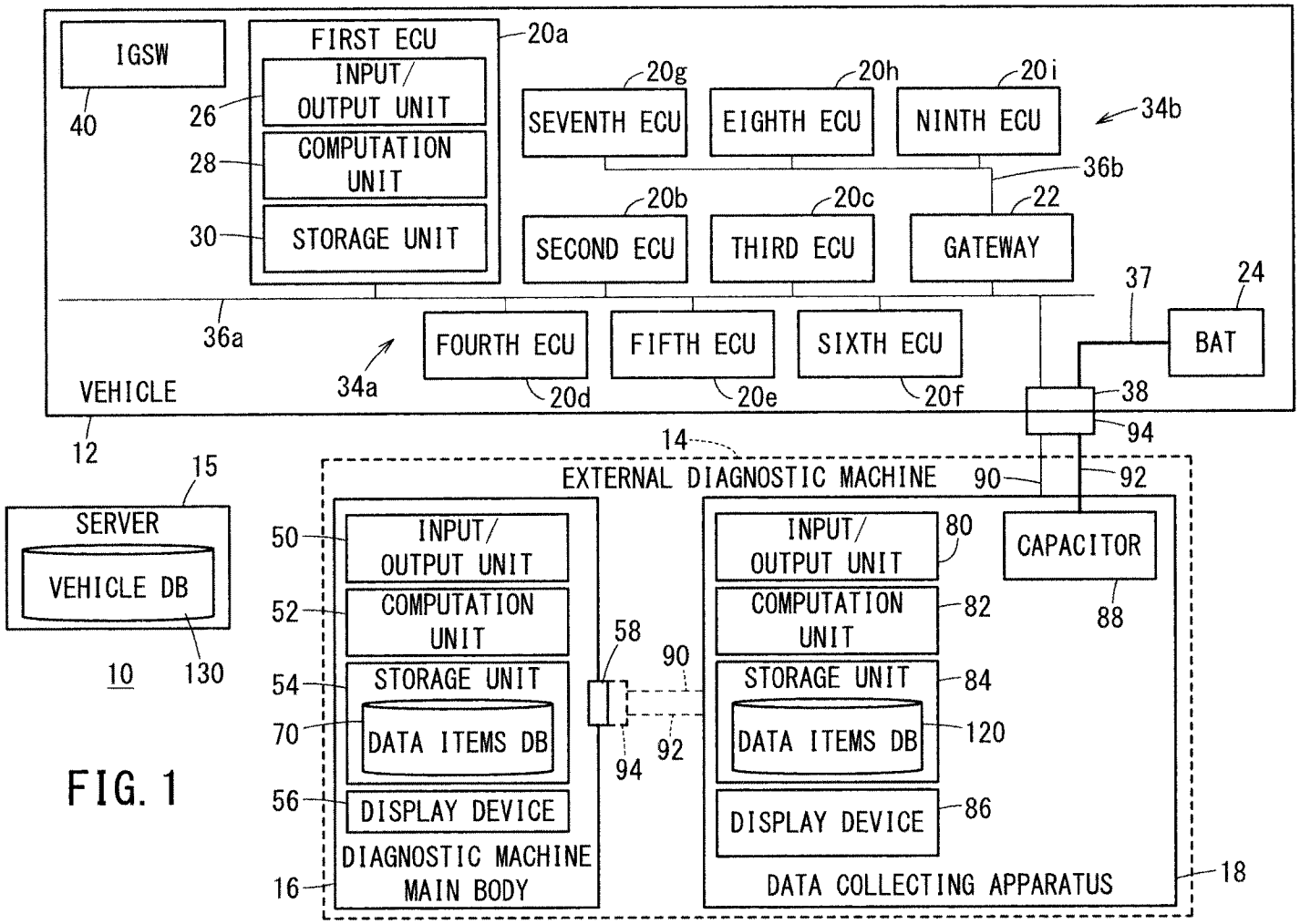
FIG. 1 is a block diagram showing an outline configuration of a diagnostic system including a data collecting apparatus according to an embodiment of the present invention.

FIG. 1 is a block diagram showing an outline configuration of a diagnostic system 10 (hereinafter also referred to as a "system 10") including a data collecting apparatus 18 according to an embodiment of the present invention. The system 10 includes a vehicle 12 that serves as a target object, an external diagnostic machine (vehicle diagnostic machine) 14 that carries out a fault diagnosis on the vehicle 12 from outside of the vehicle 12, and a server 15 that supplies information of the vehicle 12 to the external diagnostic machine 14. The external diagnostic machine 14 includes a diagnostic machine main body 16 (hereinafter also referred to as a "main body 16") and a data collecting apparatus 18 (data logger).

(1-2. Vehicle 12)

The vehicle 12 of the present embodiment is a four-wheeled vehicle in the form of a hybrid vehicle having a driving engine and a traction motor (neither of which are shown). Alternatively, the vehicle 12 may be a gasoline vehicle having only the engine and not the traction motor, an electric vehicle (battery vehicle), a fuel cell vehicle, or the like. Further, the vehicle 12 may be a vehicle in the form of a two-wheeled or three-wheeled motorcycle.

The vehicle 12 includes a plurality of electronic control units (hereinafter referred to as "first through ninth ECUs 20*a* to 20*i*" or "ECUs 20*a* to 20*i*", and referred to collectively as "ECUs 20") for controlling the vehicle 12, a gateway 22, and a low voltage battery 24 (hereinafter also referred to as a "battery 24"). In FIG. 1, to facilitate understanding, although only nine ECUs 20*a* to 20*i* are illustrated, ECUs 20 apart from those illustrated can be provided. The number of ECUs 20, for example, can be any number ranging from two to several hundreds.

As examples of such ECUs 20, there can be offered, for example, an engine ECU, a motor ECU, a transmission ECU, a vehicle stability assist ECU (hereinafter referred to as a "VSA assist ECU), an antilock brake system ECU (hereinafter referred to as an "ABS ECU"), an electric power steering ECU (hereinafter referred to as an "EPS ECU"), a battery ECU, a meter ECU, an air conditioner ECU, a supplemental restraint system ECU (hereinafter referred to as an "SRS ECU"), and an immobilizer ECU, etc.

The engine ECU controls the output of the non-illustrated engine. The motor ECU controls the output of the non-illustrated traction motor. The transmission ECU controls a non-illustrated transmission. The VSA ECU implements a vehicle stability assist control. The ABS ECU implements an antilock brake control. The EPS ECU implements a steering assist control. The battery ECU controls charging and discharging of the low voltage battery 24 or a non-illustrated high voltage battery. The meter ECU controls a meter display device (not shown) provided on a non-illustrated instrument panel. The air conditioner ECU controls a non-illustrated air conditioner. The SRS ECU carries out control of a non-illustrated air bag system. The immobilizer ECU carries out control of an immobilizer device and a smart key system, neither of which are shown.

The respective ECUs 20 each include an input/output unit 26, a computation unit 28, and a storage unit 30. Note that in FIG. 1, the input/output unit 26, the computation unit 28, and the storage unit 30 of only the first ECU 20*a* are shown, and the internal configurations of the other ECUs 20*b* to 20*i* are omitted from illustration.

The first through sixth ECUs 20*a* to 20*f* are connected through a communications bus 36*a*, and collectively constitute an in-vehicle network 34*a* (hereinafter referred to as a "network 34*a*"). The network 34*a* in the present embodiment is a controller area network (CAN), and in particular, is a so-called high speed communications CAN (hereinafter referred to as a "high speed CAN") as defined by ISO 11898. The seventh through ninth ECUs 20*g* to 20*i* are connected through a communications bus 36*b*, and collectively constitute an in-vehicle network 34*b* (hereinafter referred to as a "network 34*b*"). The network 34*b* in the present embodiment is a CAN, and in particular, is a so-called low speed communications CAN (hereinafter referred to as a "low speed CAN") as defined by ISO 11519. Alternatively, the principles of the present invention can be applied to other networks apart from the above-described networks 34*a*, 34*b*, such as a local interconnect network (LIN), FlexRay, and K-line networks or the like. Hereinbelow, the networks 34*a*, 34*b* will be referred to collectively as an in-vehicle network 34 or a network 34.

The communications bus 36*a* and a power line 37 from the battery 24 are connected to a data link connector 38 disposed in the vehicle cabin (e.g., as part of a non-illustrated instrument panel).

Although as shown in FIG. 1, the power line 37 from the battery 24 is connected only to the connector 38, the battery 24, which is a 12 volt battery for example, serves to supply power to respective constituent elements (e.g., the ECUs 20*a* to 20*i*) of a low voltage system of the vehicle 12.

Further, power is supplied through an ignition switch 40 (hereinafter referred to as an "IGSW 40") to all of the ECUs 20 that are installed in the vehicle 12, and in the event that the IGSW 40 is turned off, among the ECUs 20, cases exist in which supply of power from the battery is received and activation thereof is continued. In this case, settings are made such that operations, which differ from those when the IGSW 40 is turned on, continue.

(1-3. External Diagnostic Machine 14)

As noted above, the external diagnostic machine includes the diagnostic machine main body 16 and the data collecting apparatus 18.

(1-3-1. Diagnostic Machine Main Body 16)

(1-3-1-1. Outline Description)

The diagnostic machine main body 16 carries out respective type settings (operation settings) of the data collecting apparatus 18, together with analyzing driving parameter data D (hereinafter referred to as "data D") that is collected by the data collecting apparatus 18, and performing a fault diagnosis. In addition to or instead of the fault diagnosis, other diagnostic procedures may also be performed (to be described in detail later).

As shown in FIG. 1, the main body 16 includes an input/output unit 50, a computation unit 52, a storage unit 54, a display device 56, and a connector 58.

The main body 16 can be constituted from a commercially available notebook personal computer, a tablet computer, or a smart phone, for example. The main body 16 is not necessarily required to be made up from a single body, and for example, may be constituted from a personal computer as a main body and a slave unit (repeater) that serves as an interface between the personal computer and the data collecting apparatus 18.

(1-3-1-2. Various Functions of the Computation Unit 52)

Figure 2:
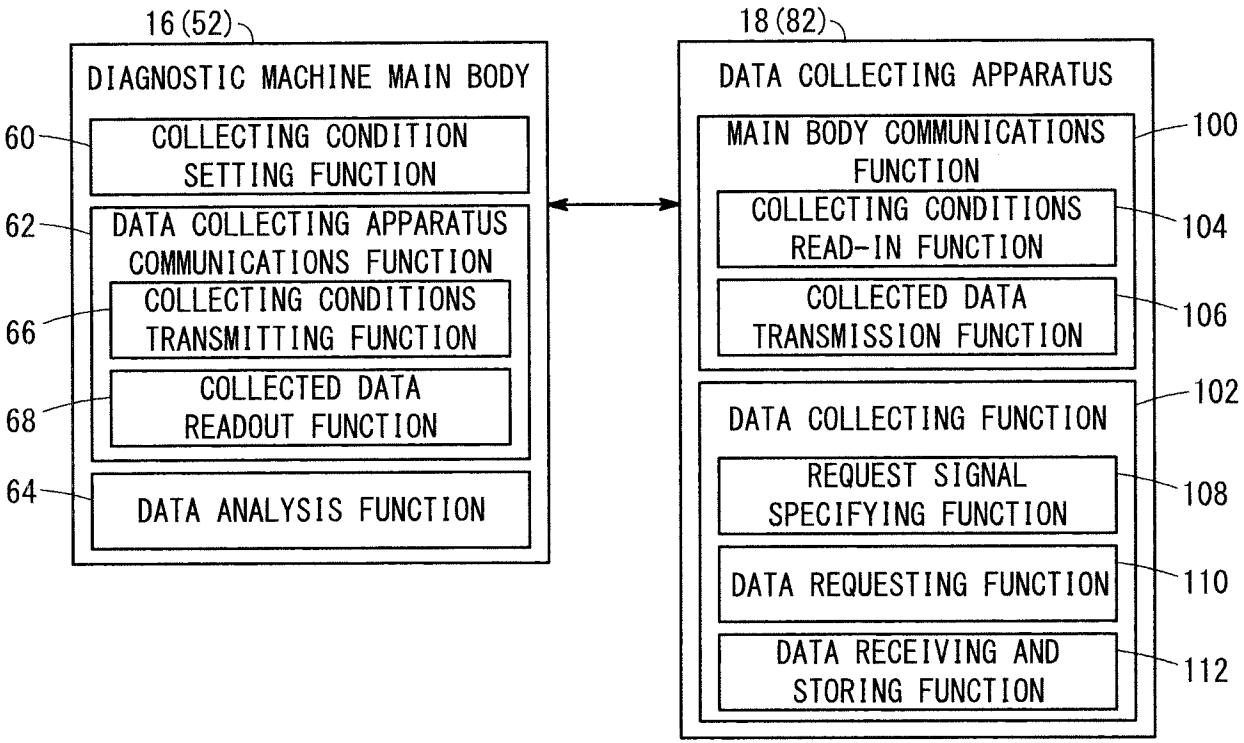
FIG. 2 is a view showing various functions possessed by a diagnostic machine main body and the data collecting apparatus.

FIG. 2 is a view showing the various functions possessed by the diagnostic machine main body 16 and the data collecting apparatus 18. As shown in FIG. 2, the diagnostic machine main body 16 includes a collecting condition setting function 60, a data collecting apparatus communications function 62, and a data analysis function 64. The respective functions 60, 62, 64 are realized by the computation unit 52 executing programs that are stored in the storage unit 54.

The collecting condition setting function 60 sets data collecting conditions, which are conditions by which the data collecting apparatus 18 collects the data D (e.g., acquisition target items, acquisition periods for the data D).

The data collecting apparatus communications function 62 is a function associated with communications with the data collecting apparatus 18. The communications function 62 includes a collecting conditions transmitting function 66 for transmitting the data collecting conditions to the data collecting apparatus 18, and a collected data readout function 68 for reading out the data D from the data collecting apparatus 18.

The data analysis function 64 carries out data analysis for fault diagnosis using the data D acquired from the data collecting apparatus 18. The data analysis function 64 serves as a fault determiner that determines an ECU 20 (hereinafter referred to as a "faulty ECU 20mal") in which a fault is generated. Further, the data analysis function 64 also functions as an installed ECU specifier for communicating with the server 15 and specifying an ECU (hereinafter referred to as an "installed ECU 20ins") that is installed in the vehicle 12. When the installed ECU 20ins is specified, a vehicle identification number (hereinafter referred to as "VIN") of the vehicle 12 is used (details will be described later).

(1-3-1-3. Storage Unit 54)

The storage unit 54 (see, FIG. 1) stores various programs and various databases required for executing the functions 60, 62, 64. The databases include a data item database 70 (hereinafter referred to as a "data item DB 70" or a "DB 70"). Items of the data D (hereinafter referred to as data items Idata), which can be collected by the data collecting apparatus 18, are accumulated in the DB 70. In the DB 70, the data items Idata are classified based on types of the vehicle 12 corresponding to the drive source thereof. As types of vehicles 12 corresponding to the drive source thereof, there can be included, for example, a gasoline vehicle, a diesel vehicle, a hybrid vehicle, and an electric vehicle, etc.

(1-3-2. Data Collecting Apparatus 18)

(1-3-2-1. Outline Description)

The data collecting apparatus 18 gathers and collects the driving parameter data D in the vehicle 12. As shown in FIG. 1, the data collecting apparatus 18 includes an input/output unit 80, a computation unit 82, a storage unit 84, a display device 86, a capacitor 88, a communications line 90, a power line 92, and a connector 94. The connector 94 is a USB connector, for example.

(1-3-2-2. Various Functions of the Computation Unit 82)

As shown in FIG. 2, the data collecting apparatus includes a main body communications function 100 and a data collecting function 102. The respective functions 100, 102 are realized by the computation unit 82 executing programs that are stored in the storage unit 84. The main body communications function 100 is a function associated with communications with the diagnostic machine main body 16, and the data collecting function 102 is a function associated with collection of data D from the vehicle 12.

The main body communications function 100 includes a collecting conditions read-in function 104 and a collected data transmission function 106. The collecting conditions read-in function 104 is a function for reading in from the diagnostic machine main body 16 the conditions (data collecting conditions) by which the data collecting apparatus 18 collects the data D. The collected data transmission function 106 is a function for sending the data D that the data collecting apparatus 18 has collected, to the diagnostic machine main body 16.

The data collecting function 102 includes a request signal specifying function 108, a data requesting function 110, and a data receiving and storing function 112. The request signal specifying function 108 is a function for specifying the data request signal Sreq for requesting transmission of data D with respect to the vehicle 12. The data requesting function 110 is a function for transmitting the data request signal Sreq with respect to an ECU 20 (hereinafter referred to as a "target ECU 20tar"), which serves as a target from which data D is requested, and thereby requesting specified items of the data D. The data receiving and storing function 112 is a function for receiving the data D that the target ECU 20tar has output responsive to the data request signal Sreq, and storing the data D in the storage unit 84 (data storage unit).

(1-3-2-3. Storage Unit 84)

The storage unit 84 (see, FIG. 1) stores various programs and various databases required for executing the functions 100, 102. The databases include a data item database 120 (hereinafter referred to as a "data item DB 120", an "item DB 120", or a "DB 120"). In the same manner as the DB 70 of the main body 16, items of the driving parameter data D (data items Idata), which can be collected by the data collecting apparatus 18, are accumulated in the DB 120 of the data collecting apparatus 18. However, the data items Idata accumulated in the DB 120 are made up only of the items that are received from the main body 16. Stated otherwise, the data items Idata accumulated in the DB 120 are a portion of the data items Idata that are stored in the DB 70. The DB 120 functions as a data item storage unit.

(1-3-2-4. Capacitor 88)

The capacitor 88 is charged by power from the battery 24, and supplies the power to the interior of the data collecting apparatus 18 when the connector 94 is detached from the connector 38.

Although as shown in FIG. 1, the power line 92 from the connector 94 is connected only to the capacitor 88, in addition to the capacitor 88, the power line 92 also is connected to other sites (for example, the computation unit 82). Therefore, power from the battery 24 or the capacitor 88 also is supplied to such other sites.

(1-4. Server 15)

The server 15 supplies various information of the vehicle 12 with respect to the external diagnostic machine responsive to the request from the external diagnostic machine 14. The server 15 is equipped with an input/output unit, a computation unit, a storage unit, and a display device, none of which are shown. As shown in FIG. 1, the server 15 is provided with a vehicle database 130 (hereinafter referred to as a "vehicle DB 130"), in which various information relating to the vehicle 12 is stored. The vehicle DB 130 is included in the storage unit of the server 15.

[2. Content of Driving Parameter Data D]

The driving parameter data D in the present embodiment is content used for performing a fault diagnosis of the vehicle 12, and for example, can include the following content items.

For example, in the case of diagnosing the driving state (in relation to the engine and the traction motor) of the vehicle 12, the data D to be acquired is obtained by specifying the engine ECU and the motor ECU.

In this case, as data D that is acquired from the engine ECU, for example, there are included a vehicle velocity detected by a non-illustrated vehicle velocity sensor, an engine coolant temperature detected by a non-illustrated temperature sensor, a number of rotations (RPM) of the engine, which is calculated by the engine ECU based on a crank angle detected by a non-illustrated crank angle sensor, an intake pressure detected by a non-illustrated intake pressure sensor, and various setting values of the engine ECU.

As data D that is acquired from the motor ECU, for example, there are included a number of rotations (RPM) of the motor, which is calculated by the motor ECU based on an output from a non-illustrated resolver, a remaining capacity of a high-voltage battery for the driving motor, and various setting values of the motor ECU.

[3. Fault Diagnosis]

Next, various operations and processes concerning a fault diagnosis in the present embodiment will be described.

(3-1. Overall Flow)

Figure 3:
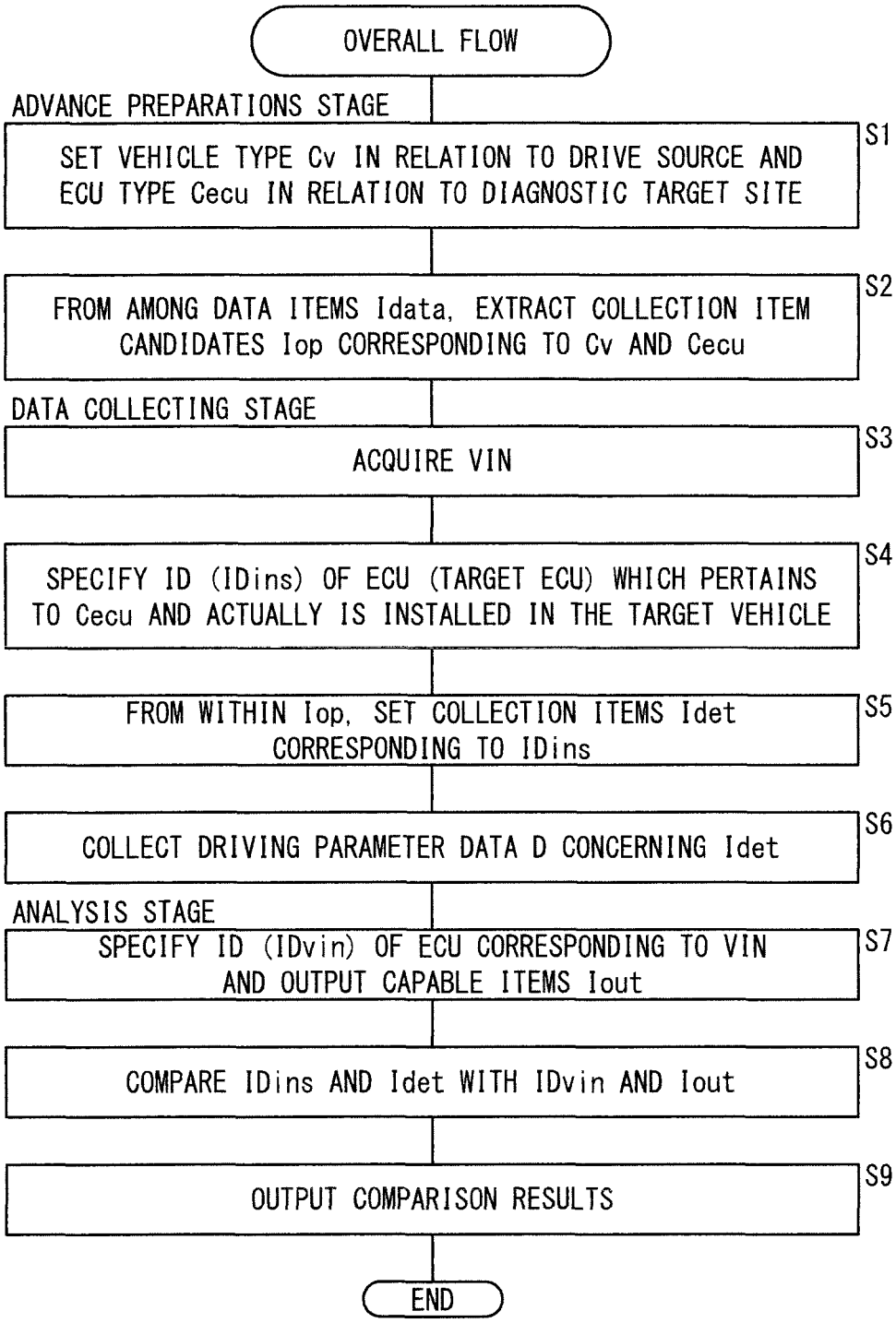
FIG. 3 is a flowchart showing by way of example an overall flow of operations of an operator and processes of an external diagnostic machine and a server, for performing a fault diagnosis according to the present embodiment.
Figure 4:
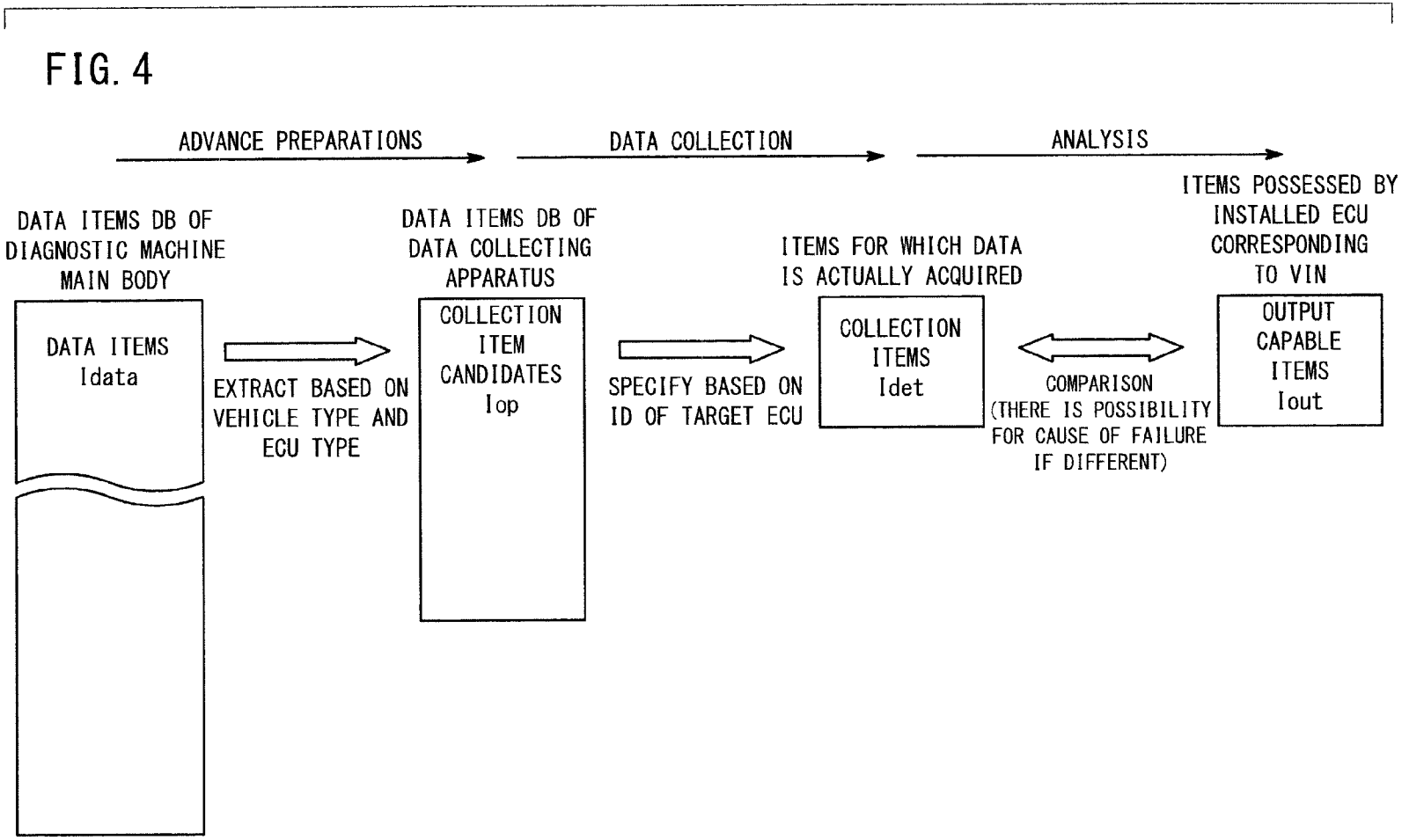
FIG. 4 is a view for describing data items that are used in the operations and processes of FIG. 3.

FIG. 3 is a flowchart showing by way of example an overall flow of operations of an operator and processes of the vehicle 12, the external diagnostic machine 14, and the server 15, for performing a fault diagnosis according to the present embodiment. FIG. 4 is a view for describing the data items Idata that are used in the operations and processes of FIG. 3.

Steps S1 and S2 of FIG. 3 are processes carried out at a stage of advance preparations, steps S3 through S6 are processes carried out at a stage of connecting the data collecting apparatus 18 to the vehicle 12 and actually collecting data D, and steps S7 through S9 are processes carried out at a state of detaching the data collecting apparatus 18 from the vehicle 12 after collection of the data D, and analyzing a cause of the fault.

In step S1, with the external diagnostic machine (the main body 16 and the data collecting apparatus 18), the type of the vehicle 12 in relation to the drive source (hereinafter also referred to as a "vehicle type Cv" or a "type Cv"), and the type of ECU 20 in relation to the diagnostic target site (hereinafter also referred to as an "ECU type Cecu" or a "type Cecu") are set based on inputs from the operator.

Among the vehicle types Cv that can be selected, there may be included, for example, a gasoline vehicle, a diesel vehicle, and a hybrid vehicle. Among the ECU types Cecu that can be designated as acquisition targets, plural ECUs may be included, for example, such as the engine ECU, the motor ECU, the transmission ECU, etc.

In step S2, in the external diagnostic machine 14, from among the data items Idata that are included in the data item DB 70 of the main body 16, items corresponding to the types Cv, Cecu (hereinafter referred to as "collection item candidates Iop") are extracted, and are stored in the data item DB 120 of the data collecting apparatus 18 (see FIG. 4). Accordingly, the collection item candidates Iop corresponding to the types Cv, Cecu are designated.

Subsequently, in steps S3 through S6, using the data collecting apparatus 18 that is attached to the vehicle 12, collection of data D is actually carried out. More specifically, in step S3, the data collecting apparatus 18 acquires the VIN from the vehicle 12.

In step S4, from among plural ECUs 20 belonging to the ECU type Cecu set during the advance preparations (step S1), the data collecting apparatus 18 specifies identifying information (ID) of the ECU 20 (i.e., the target ECU 20tar) that actually is installed in the diagnostic target vehicle 12. In this case, the data collecting apparatus 18 specifies each of the IDs of the plural ECUs 20 that belong to the ECU type Cecu, and the data collecting apparatus 18 queries each of the ECUs 20 by communication therewith as to which ID of the specified IDs the ECU 20 actually installed in the vehicle 12 has. Hereinbelow, the ID of an ECU 20 (target ECU 20tar) that actually is installed in the vehicle 12 is referred to as an "IDins".

In step S5, among the collection item candidates Iop extracted (or stored) during the advance preparations (step S2), the data collecting apparatus 18 sets, as items of data D to be actually collected (hereinafter referred to as "collection items Idet"), items of the ECU 20 corresponding to the IDins that was designated in step S4 as being an installed ECU 20 (installed ECU 20ins) (see FIG. 4). Consequently, it is possible to automatically set the actual collection items Idet responsive to the installed ECU 20ins.

In step S6, concerning the collection Items Idet that were set in step S5, the data collecting apparatus 18 collects driving parameter data D from the vehicle 12. The collection period for the data D is typically on the order of one week. However, in the case of diagnosing the cause of a fault that is difficult to identify, the collection period may take place over a longer period.

When collection of the data D is completed, then in steps S7 through S9, the data collecting apparatus 18 reads the collected data D into the main body 16 of the external diagnostic machine 14, and an analysis is performed to determine a cause of the fault. First, in step S7, in the main body 16 of the external diagnostic machine 14, the ID and the output capable items Iout (hereinafter also referred to as "collection scheduled items Iex") of the ECU 20 (i.e., the target ECU 20tar), which corresponds to the VIN acquired during collection of the data D (step S3), are specified.

According to the present embodiment, in the server 15, which can be connected through an Internet environment, the vehicle DD 130 is provided, in which ECU installation data for each vehicle 12 are associated with VINs and stored. After a VIN has been acquired from the data collecting apparatus 18, the main body 16 notifies the VIN to the server 15. The server 15 reads out from the vehicle DB 130 the output capable items Iout and the identifying information IDvin of the ECU 20 (i.e., the target ECU 20tar) corresponding to the VIN that was notified thereto, and notifies the same to the main body 16. (In the following description, the ID of the target ECU 20tar corresponding to the VIN may also be referred to as an "IDvin".)

In step S8, the main body 16 compares with each other the IDins that the data collecting apparatus 18 has acquired from the vehicle 12 (step S4) and the collection items Idet based on the IDins (step S5), and the IDvin acquired from the server 15 and the output capable items Iout (step S7) based on the IDvin (refer to FIG. 4).

In step S9, the main body 16 outputs the results of the comparison performed in step S8. If the collection items Idet that actually are collected from the vehicle 12 are missing with respect to the output capable items Iout corresponding to the installed ECU 20ins confirmed by the VIN of the vehicle 12, it is presumed that a communications error has occurred concerning the missing collection items Idet, and it is possible to determine that a fault is occurring in the target ECU 20tar. Further, if the collection items Idet and the output capable items Iout are the same, then there is no communications error between the data collecting apparatus 18 and each of the target ECUs 20tar. Thus, the data collecting apparatus 18 collects the data, and thereafter, the operator carries out a diagnostic operation based on the data D that is read into the diagnostic machine main body 16.

(3-2. Advance Preparations)

(3-2-1. Overall Flow of Advance Preparations)

Figure 5:
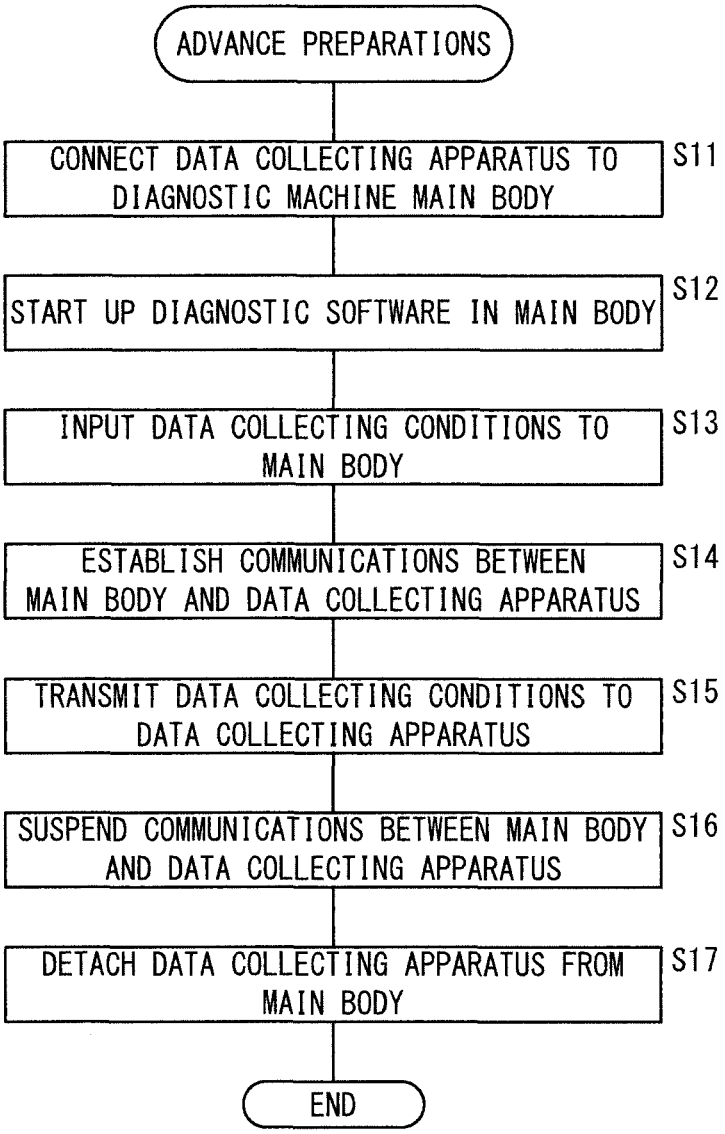
FIG. 5 is a flowchart showing by way of example operations of the operator as advance preparations for collecting driving parameter data, along with processes of the diagnostic machine main body and the data collecting apparatus.

FIG. 5 is a flowchart showing by way of example operations of an operator as advance preparations for collecting the driving parameter data D, along with processes of the diagnostic machine main body 16 and the data collecting apparatus 18. The content shown in FIG. 5 indicates in greater detail steps S1 and S2 of FIG. 3. In step S11 of FIG. 5, the operator (a technician or the like) connects the connector 94 of the data collecting apparatus 18 to the connector 58 of the diagnostic machine main body 16.

Figure 6:
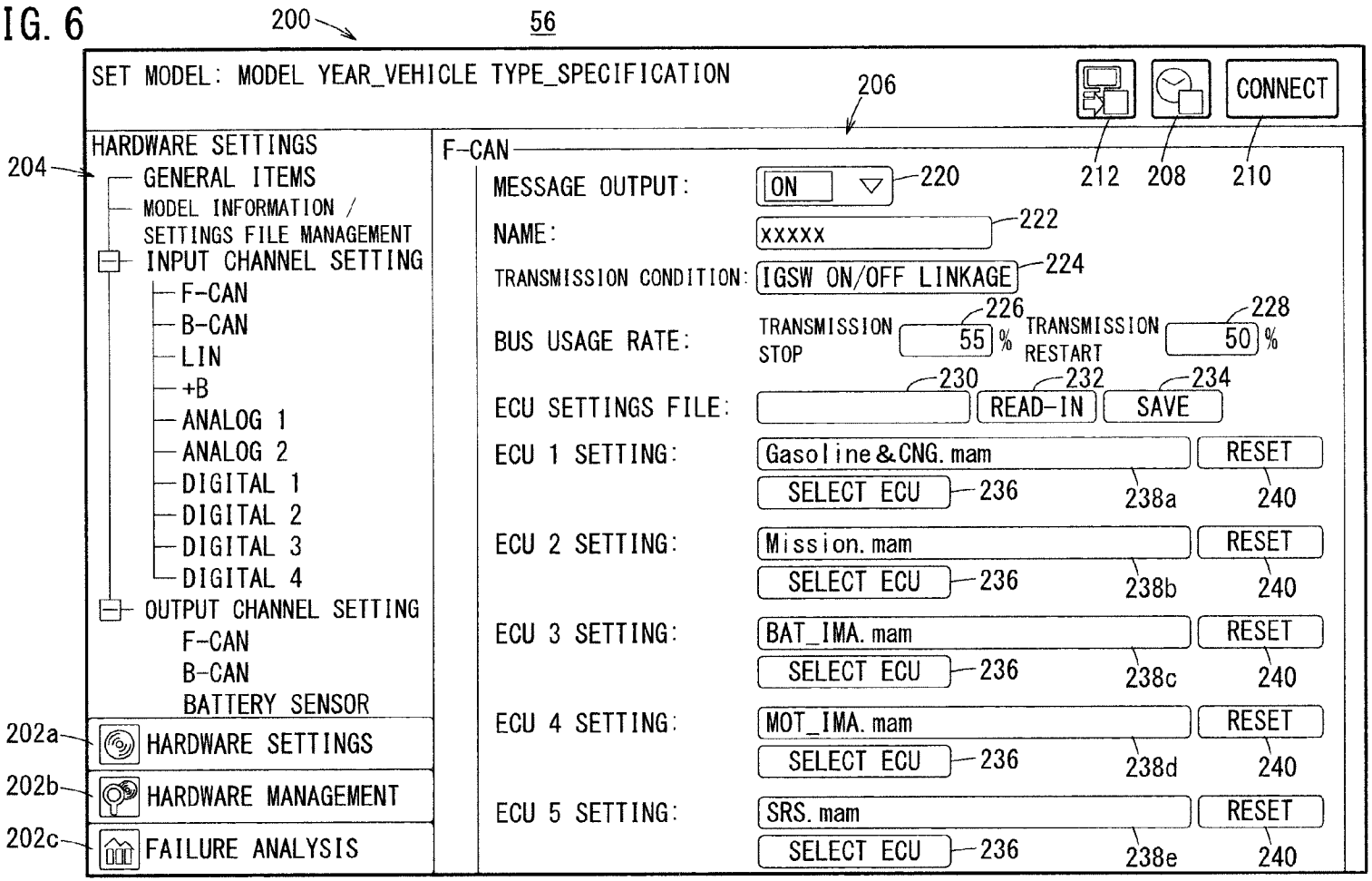
FIG. 6 is a view showing by way of example an input screen that is used when data collecting conditions are input according to the embodiment.

In step S12, the operator operates the input/output unit 50 (mouse, keyboard, or the like) of the diagnostic machine main body 16 in order to start the diagnostic software that is used to collect the driving parameter data D. Accompanying starting of the diagnostic software, as shown in FIG. 6, for example, the diagnostic machine main body 16 displays on the display device 56 a display screen 200 (hereinafter also referred to as an "input screen 200") relating to collection of the data D. The order of steps S11 and S12 may be reversed.

In step S13, data collecting conditions (details of which will be described later) are input by the operator making an input through the display screen 200.

In step S14, by the operator making an input through the display screen 200, a request is made to open communications between the diagnostic machine main body 16 and the data collecting apparatus 18. The main body 16 (data collecting apparatus communications function 62), which has received the request, opens communications with the data collecting apparatus 18. Note that the order of step S13 and step S14 may be reversed.

In step S15, by an input made through the display screen 200, the operator requests the main body 16 to change the data collecting conditions for the data collecting apparatus 18. In response to the request, the main body 16 (collecting conditions transmitting function 66) changes the data collecting conditions for the data collecting apparatus 18 to the data collecting conditions that were entered in step S13. More specifically, the main body 16 transmits the new data collecting conditions to the data collecting apparatus 18, whereupon the data collecting apparatus 18 (collecting conditions read-in function 104) sets the received data collecting conditions as new data collecting conditions.

In step S16, by the operator making an input through the display screen 200, a request is made to cut off communications between the diagnostic machine main body 16 and the data collecting apparatus 18. The main body 16 (data collecting apparatus communications function 62), which has received the request, cuts off communications with the data collecting apparatus 18.

In step S17, the operator disconnects the connector 94 of the data collecting apparatus 18 from the connector 58 of the diagnostic machine main body 16.

(3-2-2. Data Collecting Conditions)

(3-2-2-1. Outline Description of Data Collecting Conditions)

The data collecting conditions input in step S13 of FIG. 5 include, for example, a network type (CAN, LIN, FlexRay, K-line or the like, and if a plurality of CANs (high speed CAN, low speed CAN, etc.) are applicable, which one should be selected), a bus usage rate for suspending and restarting data collection, and a type of the target ECU 20tar (or a diagnostic target site). In addition, the content disclosed in US2014/0371977A1, e.g., the time (continuous data acquiring time) for carrying out continuous acquisition of the data D, the period (continuous data acquiring period) for continuously acquiring the data D, or the total time (total data collecting time) required to collect the data D, may be specified.

Furthermore, as discussed in connection with steps S1 and S2 of FIG. 3, in the data collecting conditions input in step S13 of FIG. 5, there are included the type of the vehicle 12 (vehicle type Cv) in relation to the drive source thereof, and the type of the ECU 20 (ECU type Cecu) in relation to the diagnostic target site.

The computation unit 52 extracts from the data item DB 70 data items Idata corresponding to the input Cv, Cecu, and sets the data items Idata as a portion of the data collecting conditions that are sent to the data collecting apparatus 18.

The ECU type Cecu is a type of ECU 20 that outputs data D corresponding to the presumed cause of a fault, based on a failure symptom elicited from the user. Thereafter, as described in detail with reference to FIG. 7, although there are plural ECUs 20 contained within the ECU type Cecu, in the designated vehicle 12, there is only one ECU 20 contained within the ECU type Cecu. Therefore, the data items Idata that are extracted based on the type Cecu that was input correspond to all items of data D that are capable of being retrieved by the plurality of ECUs 20 included within the input type Cecu (see FIG. 4).

(3-2-2-2. Executable Files)

By the operator inputting the data collecting conditions into the diagnostic machine main body 16, programs (executable files Fexe) are generated that are executed by the data collecting apparatus 18. The executable files Fexe take the form of file packages that are generated for each type Cv of vehicle 12 in relation to the drive source thereof.

The following files are included within the file packages:

(a) a program file (VIN acquisition file Fvin) for obtaining the VIN; and (b) a program file (data acquisition file Fdata) for obtaining data D from the ECUs 20*a* to 20*i* of the respective networks 34*a*, 34*b*.

The VIN acquisition file Fvin can be set for each of the networks 34*a*, 34*b*. For example, a file Fvin that is used by the high speed CAN network 34*a*, is set as "VIN.unt", wherein the file extension "unt" is used as an extension of the file (program) for the purpose of acquiring the VIN.

The data acquisition file Fdata can be set for each of the diagnostic target sites or for each of the types Cecu of the ECUs 20 that pertain to the target ECU 20tar. A plurality of data acquisition files Fdata are set in the case that multiple diagnostic target sites are set. For example, in the case that the transmission is set as a diagnostic target site (stated otherwise, if the transmission ECU is selected as an ECU type Cecu), the file Fdata is set as "MISSION.mam", wherein the file extension "mam" is used as an extension of the file (program) for the purpose of acquiring the data D. The extension used by the file Fdata is changed for each of the networks 34*a*, 34*b*.

By dividing and separating the VIN acquisition file Fvin and the data acquisition file Fdata, it is possible to exclude the ECU 20 (e.g., the ECU 20*a*) in which the VIN is stored, from among the objects of the data acquisition file Fdata.

Further, the type of the executable file Fexe (file package) is set by using a specified input screen. More specifically, if the option "Model Information/Settings File Management" is selected in a hardware settings selecting section 204 of a later-described input screen 200 (see, FIG. 6), then an input screen (not shown) is displayed, and settings can be made on the displayed input screen.

(3-2-2-3. Input of Data Collecting Conditions)

(3-2-2-3-1. Outline Description of Input Screen 200)

FIG. 6 is a view showing by way of example an input screen 200 that is used when the data collecting conditions are input. FIG. 7 is a view showing by way of example various types of information (identifying information (ID) of the target ECU 20tar, etc.) corresponding to the type of diagnostic target site or the type (type Cecu) of the ECU 20 to which the target ECU 20tar belongs. In FIG. 7, the label "CNG vehicle" implies a compressed natural gas automobile, and the label "FFV" implies a flexible-fuel vehicle.

When the data collecting conditions are input, initially, the type Cv of the vehicle 12 in relation to the drive source thereof (gasoline vehicle/CNG vehicle/FFV, hybrid vehicle, etc.) is specified (input). In addition, by an operation of the user, an input screen 200 as shown in FIG. 6 is displayed.

As shown in FIG. 6, the input screen 200 includes menu selection buttons 202*a* to 202*c*, a hardware settings selecting section 204, a data collecting conditions input section 206, a conditions input button 208, a connection button 210, and a data read-in button 212.

(3-2-2-3-2. Menu Selection Buttons 202*a* to 202*c*)

The menu selection buttons 202*a* to 202*c* are buttons for selecting from among multiple menus ("Hardware Settings", "Hardware Management", "Failure Analysis"). According to the present embodiment, for inputting the data collecting conditions of the data collecting apparatus 18, the button 202*a* (hardware settings) is selected. Further, for carrying out a later-described data analysis (step S55 of FIG. 10), the button 202*c* (failure analysis) is selected.

(3-2-2-3-3. Hardware Settings Selecting Section 204)

The hardware settings selecting section 204 (hereinafter also referred to as a "selecting section 204") is an area for, by means of a pointer (not shown), selecting choices for hardware settings such as setting an input channel (CH), setting an output channel, or the like. The selecting section 204 may be scrollable depending on the size of the displayed data (the same also applies to the data collecting conditions input section 206, etc.).

(3-2-2-3-4. Data Collecting Conditions Input Section 206)

The data collecting conditions input section 206 (hereinafter also referred to as an "input section 206") is an area in which input fields are displayed depending on the selected choices made in the selecting section 204. In the example of FIG. 6, a case is shown in which a high speed CAN (i.e., the network 34*a*) is selected as a setting for the output channel in the selecting section 204. In addition to or in place thereof, settings concerning another network (e.g., the low speed CAN network 34*b*) can be carried out.

As shown in FIG. 6, the input section 206 includes a message output settings field 220, a filename input field 222, a transmission conditions display field 224, a transmission stop conditions input field 226, a transmission restart conditions input field 228, an ECU settings file input field 230, a read-in button 232, a save button 234, ECU selection buttons 236, ECU settings display fields 238*a* to 238*e*, and reset buttons 240.

The message output settings field 220 is a field for setting whether or not a guidance message is displayed on the display device 86 of the data collecting apparatus 18. The filename input field 222 is a field for inputting the name of the executable file Fexe (file package). The transmission conditions display field 224 is a field for displaying conditions by which the data collecting apparatus 18 starts transmission of the data request signal Sreq (stated otherwise, conditions for initiating collection of the data D).

The transmission stop conditions input field 226 is a field for displaying conditions (bus usage rate threshold) for cutting off transmission of the data request signal Sreq by the data collecting apparatus 18 in the event that the data D is currently being collected. The transmission restart conditions input field 228 is a field for displaying conditions (bus usage rate threshold) for restarting transmission of the data request signal Sreq by the data collecting apparatus 18 in the event that transmission of the data request signal Sreq is currently suspended.

The ECU settings file input field 230 is a field for making a text input of the data acquisition file Fdata. The read-in button 232 is a button for reading in the file Fdata that was input to the input field 230. When the button 232 is pressed, the file Fdata that was input to the input field 230 is displayed in any open field from among the ECU settings display fields 238*a* to 238*e*. The button 234 is a button for saving the content selected in the input section 206.

The ECU selection button 236 is a button for inputting a diagnostic target site (or an ECU type Cecu). When the button 236 is pressed, options for the data acquisition files Fdata are displayed, and among the displayed choices, a specified data acquisition file Fdata can be selected. In the present embodiment, input or selection of the data acquisition file Fdata includes the implication of inputting or selecting the ECU type Cecu.

The ECU settings display fields 238*a* to 238*e* are fields for displaying the data acquisition files Fdata (i.e., the ECU type Cecu or the diagnostic target site). The reset buttons 240 are buttons for resetting the files Fdata that are displayed in the display fields 238*a* to 238*e*.

(3-2-2-3-5. Conditions Input Button 208, Connection Button 210, and Data Read-in Button 212)

The conditions input button 208 is a button for causing the regions (e.g., the data collection conditions input section 206) into which the data collecting conditions are input, to be displayed. The connection button 210 is a button for establishing communications between the main body 16 and the data collecting apparatus 18, and causing the data collecting conditions that have been entered in the main body 16, to be output to the data collecting apparatus 18. The data read-in button 212 is a button for reading into the main body 16 the data D that was collected by the data collecting apparatus 18.

(3-2-2-4. Type Cecu of the Target ECU 20tar)

As discussed above, in the input screen 200 of FIG. 6, there are included the ECU selection buttons 236 for inputting the ECU type Cecu, and the ECU settings display fields 238*a* to 238*e* that display the ECU types Cecu. In the case that the processing capabilities of the data collecting apparatus 18 and each of the ECUs 20*a* to 20*i* are comparatively high, it can be considered to collect data D from the data collecting apparatus 18 with respect to all of the ECUs 20 of the vehicle 12.

However, if communication between the data collecting apparatus 18 and the respective ECUs 20 increases, the traffic over the networks 34*a*, 34*b* becomes enormous, and there is a concern that communications within the networks 34*a*, 34*b* cannot be carried out normally. Thus, in the present embodiment, in order to acquire data D concerning a site (diagnostic target site) where there is a possibility for failure symptoms to be caused which a customer has complained of concerning the vehicle 12, the number of target ECUs 20tar capable of being specified is limited depending on the type of network 34*a*, 34*b*. For example, in the case that the number of ECUs 20*a* to 20*f* contained within the network 34*a* (high speed CAN) is fifteen, the number of target ECUs 20tar capable of being specified concerning the network 34*a* is limited to a value from three to ten. The network 34*b* (low speed CAN), etc., is handled in a similar manner.

As diagnostic target sites, for example, in the case of a gasoline vehicle, a CNG vehicle, or a FFV vehicle, there can be included all or a portion of the engine, the transmission, the shift lever, an electric power steering (EPS) mechanism, a reaction force pedal mechanism, an active control mount (ACM) mechanism, an automatic cruise control (ACC) mechanism, types of meters, an electric parking brake mechanism, an acoustic vehicle alerting system (AVAS), a supplemental restraint system (SRS), and a seat belt automated fastening device. Further, in the case of a hybrid vehicle or an electric automobile, in addition to or in place of the diagnostic sites for the gasoline vehicle, etc., one or a plurality of traction motors and batteries may be included.

Generally, with the vehicle 12, in many cases, one or a plurality of diagnostic sites are controlled by a single ECU 20. For this reason, the diagnostic target sites are identified by specification of the ECU type Cecu.

According to the present embodiment, the ECU type Cecu is specified by the filename of the data D. For example, if the engine ECU is selected as the ECU type Cecu, the filename "Gasoline&CNG.mam" or "Diesel.mam" is selected (see, FIG. 7).

Further, even if the ECU types Cecu are the same, depending on the type of vehicle, cases occur in which there are multiple IDs for the target ECU 20tar. For example, as shown in FIG. 7, the identifiers "0E", "1D", and "1E" exist as IDs for the target ECU 20tar in relation to the transmission. 0E indicates a situation in which the engine ECU and the transmission ECU are both arranged in the same casing (or stated otherwise, the engine ECU and the transmission ECU are constructed integrally). 1D indicates a situation, for example, in which an automatic transmission (AT) is provided. 1E indicates a situation, for example, in which the engine ECU and the transmission ECU are disposed separately.

According to the present invention, when the ECU type Cecu is selected, all of the output capable items Iout concerning each of the plural ECUs 20 that correspond to the type Cecu are stored in the data collecting apparatus 18 for each of the IDs of the ECUs 20. The output capable items Iout are items of the driving parameter data D that are capable of being output from the ECUs 20. Hereinafter, the output capable items Iout that are selected and stored at the stage of the advance preparations will be referred to as "collection item candidates Iop".

Various information shown in FIG. 7 (stated otherwise, methods of specifying and using the ECU types Cecu) will be described together with the descriptions of the flowcharts shown in FIGS. 8 and 9.

(3-3. Operations and Processes During Collection of the Driving Parameter Data D)

(3-3-1. Overall Flow During Collection of the Driving Parameter Data D)

Figure 8:
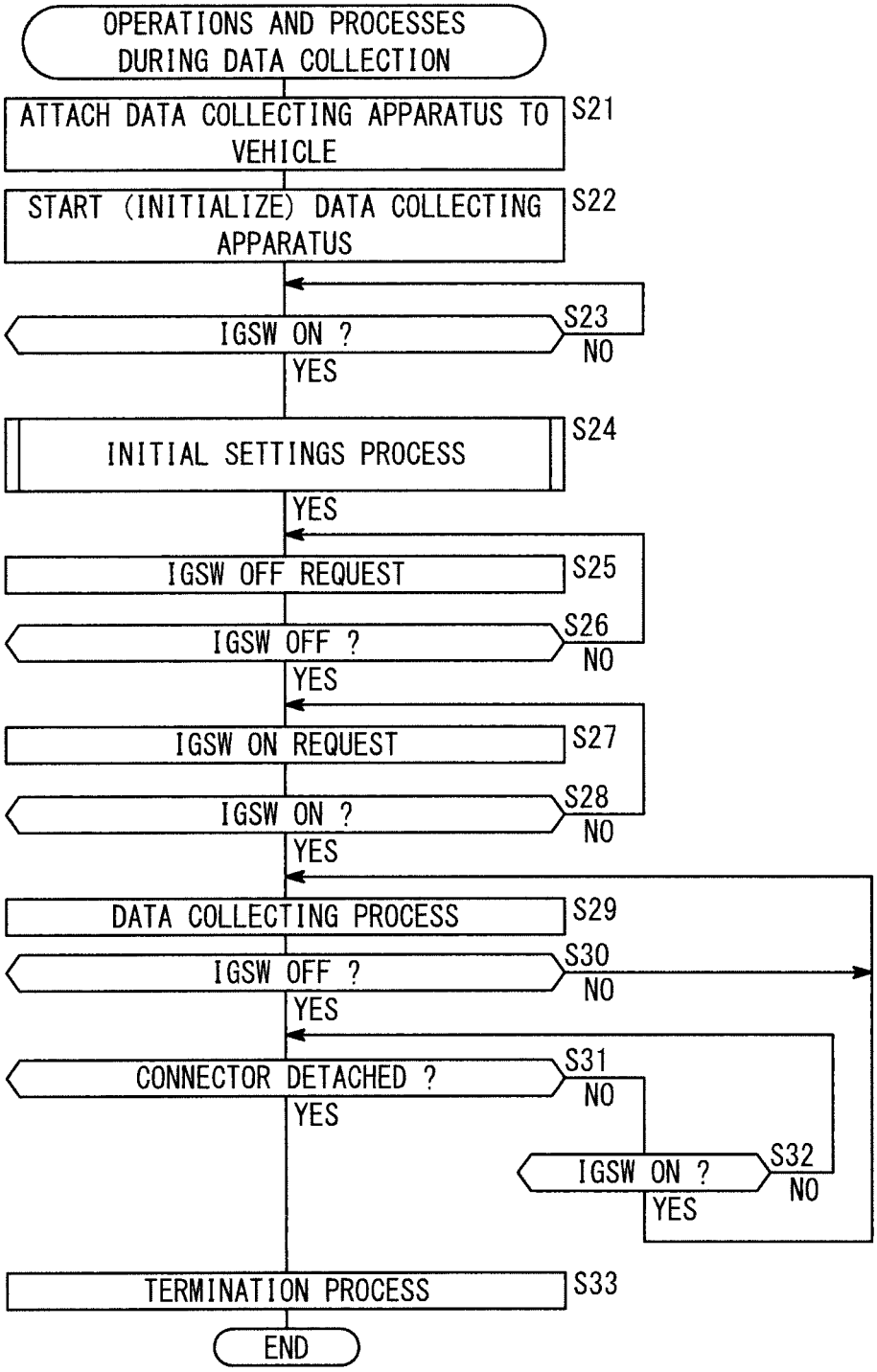
FIG. 8 is a flowchart showing by way of example operations of the operator and processes of the data collecting apparatus when the driving parameter data are collected.

FIG. 8 is a flowchart showing by way of example operations of the operator and processes of the data collecting apparatus 18 when the driving parameter data D are collected. The content shown in FIG. 8 indicates in greater detail steps S3 through S6 of FIG. 3. The processes of the data collecting apparatus 18 in FIG. 8 as well as in FIGS. 9, 10 and 12, to be described later, are executed by the computation unit 82. Further, in the case of diagnosing the cause of a fault that is difficult to identify, collection of the data D can take place over a comparatively long period (e.g., one to two weeks).

In step S21 of FIG. 8, the operator (a technician or the like) connects the connector 94 of the data collecting apparatus 18 to the data link connector 38 of the vehicle 12. There are no particular switches in the power lines 37, 92 that extend from the battery 24 to the data collecting apparatus 18 (although, preferably, a fuse is provided therein). For this reason, when connection of the connectors 38, 94 is made, power from the battery 24 of the vehicle 12 is supplied to the data collecting apparatus 18, and the data collecting apparatus 18 is activated or turned on (step S22). At this time, power from the battery is used for charging the capacitor 88 of the data collecting apparatus 18. Owing thereto, when the connector is detached, the data collecting apparatus 18 can continue to operate for a certain amount of time.

A configuration may be provided in which a switch (not shown) for enabling recording is provided on the data collecting apparatus 18. By the operator operating the switch, selection of whether or not to enable recording of data in the data collecting apparatus 18 can be performed. Further, a power source which is capable of operating the data collecting apparatus 18 over a prolonged time period may be provided in the data collecting apparatus 18 itself.

After connection of the connector 94, if power is supplied for the first time, the data collecting apparatus is initialized. The initialization process serves to newly create a save file Fsave for the data D. More specifically, if the connector 94 is reconnected after having been detached, a new save file Fsave is created. Accordingly, merely by disconnecting and then connecting the connector 94, the operator can switch the vehicle 12 that is the object of diagnosis. In this case, each of the save files Fsave is newly created.

In step S23 of FIG. 8, the data collecting apparatus 18 judges whether or not the IGSW 40 has been turned on. Such a judgment is performed by receiving a notification from the first ECU 20*a* through the network 34*a*. If the IGSW 40 is not on (step S23: NO), then step S23 is repeated.

If the IGSW 40 is on (step S23: YES), then the other ECUs 20*b* to 20*i* are activated together with the first ECU 20*a*. At this time, the data collecting apparatus 18 establishes communications with each of the ECUs 20*a* to 20*i*. Moreover, concerning any of the ECUs 20*a* to 20*i* (for example, the ECU corresponding to the immobilizer ECU), the ECU may be activated when the IGSW 40 is placed into the accessory (ACC) position.

In step S24, the data collecting apparatus 18 (request signal specifying function 108) implements an initial settings process. The initial settings process is a process for confirming the items (output capable items Iout) of the data D that are capable of being output in each of the target ECUs 20tar, and for setting the output capable items Iout as items of data D (hereinafter referred to as "collection items Idet") that the data collecting apparatus 18 acquires from the target ECU 20tar. The initial setting process is executed in association with initialization (step S22) of the data collecting apparatus 18. For this reason, a new initial settings process is not performed until the data collecting apparatus 18 is detached from the vehicle 12. Details of the initial settings process will be described later with reference to FIG. 9.

Next, in step S25, the data collecting apparatus displays on the display device 86 a request for the operator to turn off the IGSW 40. If the IGSW 40 remains on (step S26: NO), then step S25 is returned to, and the request continues to be made. If the IGSW 40 has been turned off (step S26: YES), then in step S27, the data collecting apparatus 18 displays on the display device 86 a request for the operator to turn on (turn on again) the IGSW 40. If the IGSW 40 remains off (step S28: NO), then step S27 is returned to, and the request continues to be made. If the IGSW 40 has been turned on (step S28: YES), then in step S29, the data collecting apparatus 18 executes the data collecting process.

In the data collecting process, the data request signal Sreq is sent from the data collecting apparatus 18 with respect to each of the target ECUs 20tar. The data request signal Sreq is specified by the request signal specifying function 108, and is transmitted by the data requesting function 110. The target ECUs 20tar, which have received the data request signal Sreq, send back to the data collecting apparatus 18 the data D that was requested by the data request signal Sreq. The data receiving and storing function 112 of the data collecting apparatus 18 receives the data D from each of the target ECUs 20tar, and stores the data D in the storage unit 84 (data storage unit). Concerning the details of the data collecting process, for example, the features disclosed in US2014/0371977A1 can be used.

In step S30, the data collecting apparatus 18 judges whether or not the IGSW 40 has been turned off. If the IGSW 40 remains on (step S30: NO), then step S29 is returned to, and the data collecting apparatus 18 continues the data collecting process. If the IGSW 40 has been turned off (step S30: YES), then although the vehicle 12 is stopped, the connections of the connectors 38, 94 remain as is. Therefore, in the data collecting apparatus 18, supply of power from the battery 24 is continued. In this case, the process proceeds to step S31.

In step S31, the data collecting apparatus 18 judges whether or not the connector 94 has been detached. Such a judgment is performed, for example, by monitoring signal outputs in the communications line 90 that is connected to the communications buses 36*a*, 36*b*.

If the connector 94 has not been detached (step S31: NO), then in step S32, the data collecting apparatus judges whether or not the IGSW 40 has been turned ON. If the IGSW 40 remains off (step S32: NO), then step S31 is returned to. If the IGSW 40 has been turned on (step S32: YES), then step S29 is returned to, and the data collecting apparatus 18 restarts the data collecting process. Accordingly, while the connectors 38, 94 continue to be connected, if the IGSW 40 is turned on (step S32: YES), the data collecting apparatus 18 carries out collection of data D (step S29).

At this time, the collection items Idet that were set by the initial setting process (step S24) are used. Further, while the connectors 38, 94 continue to be connected, if the IGSW 40 is turned off (step S30: YES), then the data collecting apparatus 18 stops the collection of data D and is placed in a waiting state (or a sleep state).

Returning to step S31, if the connector 94 has been detached (step S31: YES), supply of power from the battery 24 to the data collecting apparatus 18 is ended. In this case, in step S33, the data collecting apparatus 18 implements a termination process. In the termination process, a process is carried out to, for example, save the data D that has been acquired up to that point in the save file Fsave. During implementation of the termination process, power is supplied from the capacitor 88. Saving of the data D in the save file Fsave can also be carried out during the data collecting process (step S29).

Note that, if the connector 94 has been disconnected even without turning off the IGSW 40, the data collecting apparatus 18 may also implement the termination process (step S33) similarly.

(3-3-2. Initial Settings Process)

Figure 9:
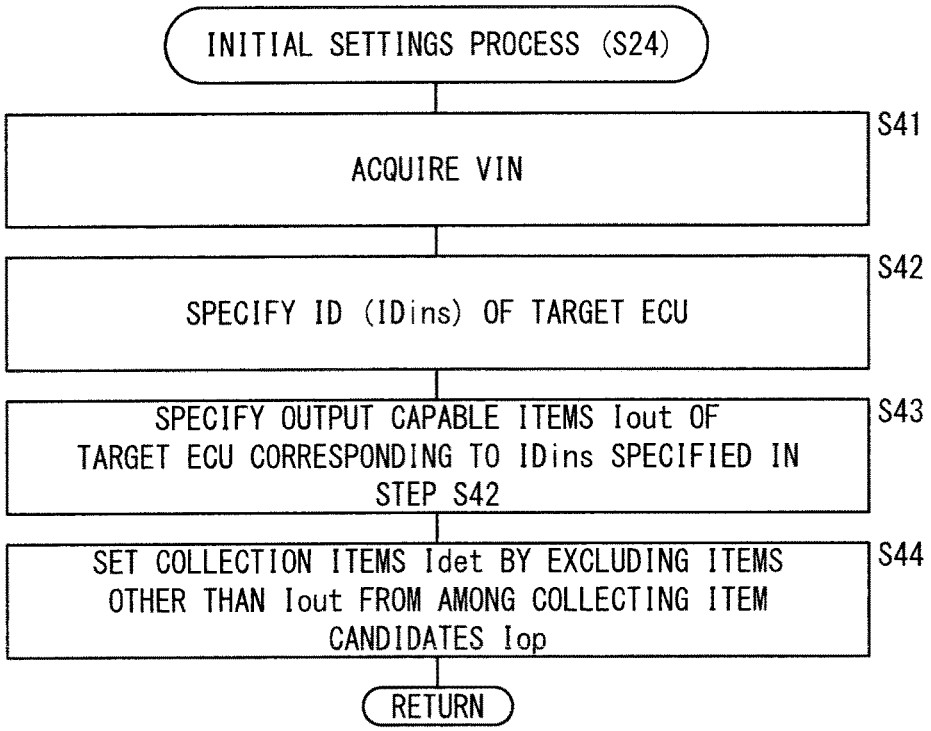
FIG. 9 is a flowchart of an initial setting process (details of step S24 of FIG. 8) according to the embodiment.

FIG. 9 is a flowchart of an initial settings process (details of step S24 of FIG. 8) in the present embodiment. In step S41, the data collecting apparatus 18 acquires the VIN from a specific ECU 20 (e.g., the ECU 20*a*) through the network 34. At this time, the data collecting apparatus 18 (i.e., the computation unit 82) executes the VIN acquisition file Fvin (e.g., "VIN.unt") (see, FIG. 7).

More specifically, the data collecting apparatus outputs, with respect to the network 34 (e.g., the network 34*a*) designated by the file Fvin, an output request command (Sreqvin) for the VIN. Each of the ECUs 20*a* to 20*f*, which has received the command Sreqvin, confirms whether or not the VIN is stored therein in the ECU itself. In addition, the ECU 20 in which the VIN is stored transmits the VIN to the data collecting apparatus 18. Note that in the present embodiment, there is only one ECU 20 in which the VIN is stored. Further, in the case that the ECU 20 in which the VIN is stored is capable of being specified beforehand, the data collecting apparatus 18 may issue a request for the VIN with respect to the specified ECU 20.

Figure 10:
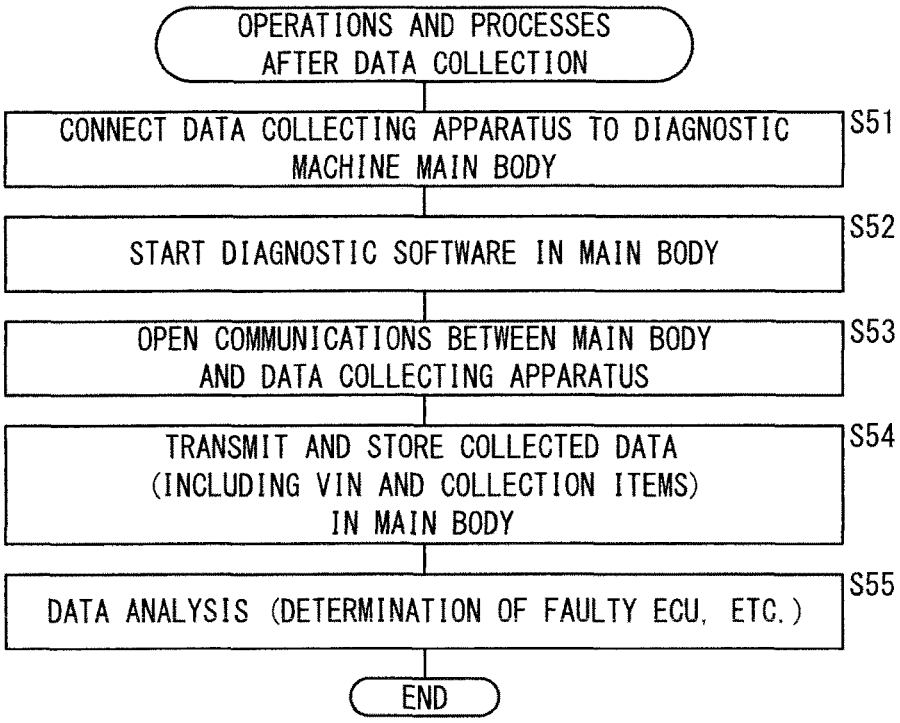
FIG. 10 is a flowchart showing by way of example operations of the operator and processes of the data collecting apparatus after the driving parameter data have been collected.

The acquired VIN is used when data analysis is performed (step S55 of FIG. 10). More specifically, the data collecting apparatus 18 stores the acquired VIN in the storage unit 84, and thereafter, outputs the VIN to the diagnostic machine main body 16.

In step S42, the data collecting apparatus 18 specifies the ID (i.e., IDins) of the target ECU 20tar. As noted above, according to the present embodiment, even though the ECU type Cecu is specified, cases occur in which the ECU 20 contained within the type Cecu differs depending on the vehicle 12. For example, in the instance of FIG. 7, there are three possibilities "0E", "1D", and "1E" as ID candidates in relation to the transmission ECU. Thus, using the three IDs, the data collecting apparatus 18 designates the IDins of the transmission ECU that actually is installed in the vehicle 12.

More specifically, the data collecting apparatus transmits one response command that includes the three IDs as addresses. In addition, the data collecting apparatus 18 sets as the IDins the ID of the target ECU 20tar from which a reply was received within a predetermined time period. Even in the case that ECUs 20 are specified as addresses in relation to the network 34*b*, it is possible to cause a reply to be issued from the gateway 22. Further, if a reply is not received from any target ECUs 20tar corresponding to the three IDs within the predetermined time period, the data collecting apparatus 18 records in the storage unit 84 that no reply was received from any of the ID candidates.

As can be understood from FIG. 7, according to the present embodiment, the ID candidates for the target ECU 20tar are held in common, regardless of the type of vehicle 12 (a gasoline vehicle or the like). Stated otherwise, the ID candidates for the target ECU 20tar are classified for each diagnostic target (or for each ECU type Cecu). In the case that plural diagnostic targets sites are present, IDs of the target ECUs 20tar are specified for each of the diagnostic target sites.

In step S43, the data collecting apparatus 18 identifies the output capable items Iout of each of the target ECUs 20tar corresponding to the IDins that were specified in step S42. As described above, when the advance preparations are performed (see, FIG. 3) and if an ECU type Cecu is selected, all of the output capable items Iout of the plural ECUs 20 that correspond to the type Cecu are stored as collection item candidates Iop in the data collecting apparatus 18 for each ID of the ECUs 20. Therefore, the output capable items Iout of the target ECUs 20tar can be identified based on the specified IDins. The output capable items Iout are items of the driving parameter data D that are capable of being output from the target ECUs 20tar.

In step S44, from among the collection item candidates Iop that are stored in the storage unit 84, the data collecting apparatus 18 excludes any items other than the output capable items Iout that were specified in step S43, to thereby set the collection items Idet. The collection items Idet are items of data D that actually are collected by the data collecting apparatus 18 in the data collecting process (step S29 of FIG. 8). Consequently, items that are included in the collection item candidates Iop but not included in the output capable items Iout, are not set as collection items Idet.

In step S44, the output capable items Iout are set directly as the collection items Idet. Further, if attention is paid to setting of the collection items Idet, the output capable items Iout can also be used directly as the collection items Idet.

(3-4. Operations and Processes after Collection of the Driving Parameter Data D)

(3-4-1. Overall Flow)

FIG. 10 is a flowchart showing by way of example operations of the operator and processes of the data collecting apparatus 18 after the driving parameter data D have been collected. In step S51, the operator (a technician or the like) connects the connector 94 of the data collecting apparatus 18 to the connector 58 of the diagnostic machine main body 16.

In step S52, the operator operates the input/output unit 50 (mouse, keyboard, or the like) of the diagnostic machine main body 16 in order to start the diagnostic software that is used for acquisition of the driving parameter data D. Accompanying starting of the diagnostic software, as shown in FIG. 11, for example, the diagnostic machine main body 16 displays on the display device 56 a display screen 300 (hereinafter referred to as a "diagnostic screen 300" or a "screen 300") relating to acquisition of the data D. The order of steps S51 and S52 may be reversed.

In step S53, by the operator making an input through the display screen 300, a request is made to open communications between the diagnostic machine main body 16 and the data collecting apparatus 18. The main body 16 (data collecting apparatus communications function 62), which has received the request, opens communications with the data collecting apparatus 18.

In step S54, by the operator making an input through the display screen 300, a request is made to the diagnostic machine main body 16 to acquire the collected driving parameter data D from the data collecting apparatus 18. Such a request is carried out through the data read-in button 212 (see, FIG. 6), for example. The main body 16 (collected data readout function 68), which has received the request, issues a request with respect to the data collecting apparatus 18 in order to transmit the collected driving parameter data D. The data collecting apparatus 18 (collected data transmission function 106), which has received the request, transmits to the main body 16 the collected driving parameter data D (including the VIN and the collection items Idet). The main body 16 (collected data readout function 68), having received the data D from the data collecting apparatus 18, stores the data D in the storage unit 54.

In step S55, the operator operates the display screen 300 of the main body 16 in order to carry out an analysis of the driving parameter data D, and identifies a cause of the fault. Within the analysis, there is included a determination of the ECU 20 (faulty ECU 20mal) in which the fault is generated. In the determination of the faulty ECU 20mal, processing on the side of the external diagnostic machine 14 primarily is carried out by the data analysis function 64 of the diagnostic machine main body 16.

When analysis of the data is carried out in step S55, it also is possible to perform an analysis using the VIN. More specifically, the ECU type Cecu is included in the data collecting conditions that were set in the advance preparations (steps S13 and S15 of FIG. 5). Further, during collection of the data, an ID of the target ECU 20tar is specified by transmission of a single response command including a plurality of ID addresses (step S42 of FIG. 9, FIG. 7). At this time, if a reply is not received from any target ECUs 20tar corresponding to the ID candidates within a predetermined time period, the data collecting apparatus 18 records in the storage unit 84 that no reply was received from any of the ID candidates.

In this manner, if no reply is received concerning any of the ID candidates, it cannot be confirmed whether the concerned type of ECU 20 is not actually installed in the vehicle 12, or whether a reply could not be received due to a failure of the ECU 20.

Thus, according to the present embodiment, information of the ECUs 20 that are installed in the diagnostic target vehicle 12 (hereinafter referred to as a "diagnostic target vehicle 12tar") is specified through the VIN. Additionally, it can be confirmed whether the concerned type of ECU 20 is not actually installed in the diagnostic target vehicle 12tar, or whether, due to a fault, no response was received from the concerned type of ECU 20 that is installed in the diagnostic target vehicle 12tar.

In order to perform the above-described confirmation, the operator specifies the types of ECUs 20 that are installed in the diagnostic target vehicle 12tar based on the VIN. More specifically, the operator enters, with respect to the server 15 through a non-illustrated display screen, a request (hereinafter referred to as an "installed ECU information request Riecu" or a "request Riecu") for seeking information of the ECUs 20 (hereinafter referred to as "installed ECUs 20ins") that are installed in the diagnostic target vehicle 12tar. The diagnostic machine main body 16 to which the request Riecu has been input, outputs to the server 15 the request Riecu and the VIN of the diagnostic target vehicle 12tar. The server 15, which has received the request Riecu and the VIN, outputs information of the installed ECUs 20ins corresponding to the received VIN.

The diagnostic machine main body 16, having received the information concerning the installed ECUs 20ins, highlights any output capable items Iout of ECUs 20 that are included in the installed ECUs 20ins but from which the data D is not collected.

(3-4-2. Display at Time of Diagnosis)

FIG. 11 is a view showing by way of example a display screen 300 of the main body 16, showing results of a comparison between collection items Idet and output capable items Iout. A detailed display section 302 is included in the screen 300.

The detailed display section 302 is a region for displaying details of the data D acquired from the data collecting apparatus 18. The detailed display section 302 includes a transmission period field 310, a category field 312, a data items field 314, a description field 316, a units field 318, and a check field 320.

The data items Idata that are shown in the detailed display section 302 include both the collection item candidates Iop and the collection items Idet. Both of the collection item candidates Iop and the collection items Idet can be obtained from the data collecting apparatus 18. Alternatively, using the data item DB 70 or the vehicle DB 130, the data item candidates Iop can be specified based on the VIN and the filename of the data acquisition file Fdata, which are acquired from the data collecting apparatus 18.

The transmission period field 310 is a field for displaying the transmission period of the data request signal Sreq from the data collecting apparatus 18. The category field 312 is a field for displaying categories of vehicles 12. In FIG. 11, as categories, types of vehicles (vehicle type Cv) in relation to the drive sources thereof are displayed.

The data items field 314 is a field for displaying data items Idata. The description field 316 is a field for displaying descriptions of the data items Idata that are displayed in the data items field 314. The units field 318 is a field for displaying the units of the data D.

The check field 320 is a field where check marks are indicated for collection items Idet that are present (items of data D that actually are acquired by the data collecting apparatus 18), whereas check marks are not indicated for collection items Idet that are not present, among the output capable items Iout. The action of applying the check marks can be carried out using an output (results of comparing the collection items Idet and the output capable items Iout) from the data collecting apparatus 18. Alternatively, the check marks can be applied by the computation unit 52 of the main body 16 comparing the collection items Idet and the output capable items Iout.

As described above, in step S44 of FIG. 9, the output capable items Iout are set directly as the collection items Idet. There is a possibility for certain ones or the output capable items Iout sent from the target ECU 20tar of the gateway 22 to be missing. In such a situation, the items that are missing are considered to be a cause of a failure symptom.

By confirming the displayed content in the check field 320, the operator can identify any missing output capable items Iout, and thus can make the best use of the missing output capable items Iout in order to perform the fault diagnosis. More specifically, in a case where, in spite of being displayed as one output capable item Iout, a data item Idata is not checked in the check field 320, the operator can make a judgment that a failure is occurring therein (or stated otherwise, can judge that a failure is occurring in the ECU 20 which was supposed to output data D of the not-checked data item Idata). As noted above, an ECU 20 in which such a fault is generated may also be referred to as a faulty ECU 20mal.

The main body 16 may also display in highlighting any of such missing items. The highlighting can be effected, for example, using a change in color, an increase in brightness, or flashing of characters or character backgrounds, etc. In addition to or in place thereof, missing items may be combined with the cause of failure assumed to be responsible therefor and recorded as a database in the storage unit 54, and the failure causes corresponding to the missing items may be displayed or output externally.

(3-4-3. Determination of Faulty ECU 20mal)

Figure 12:
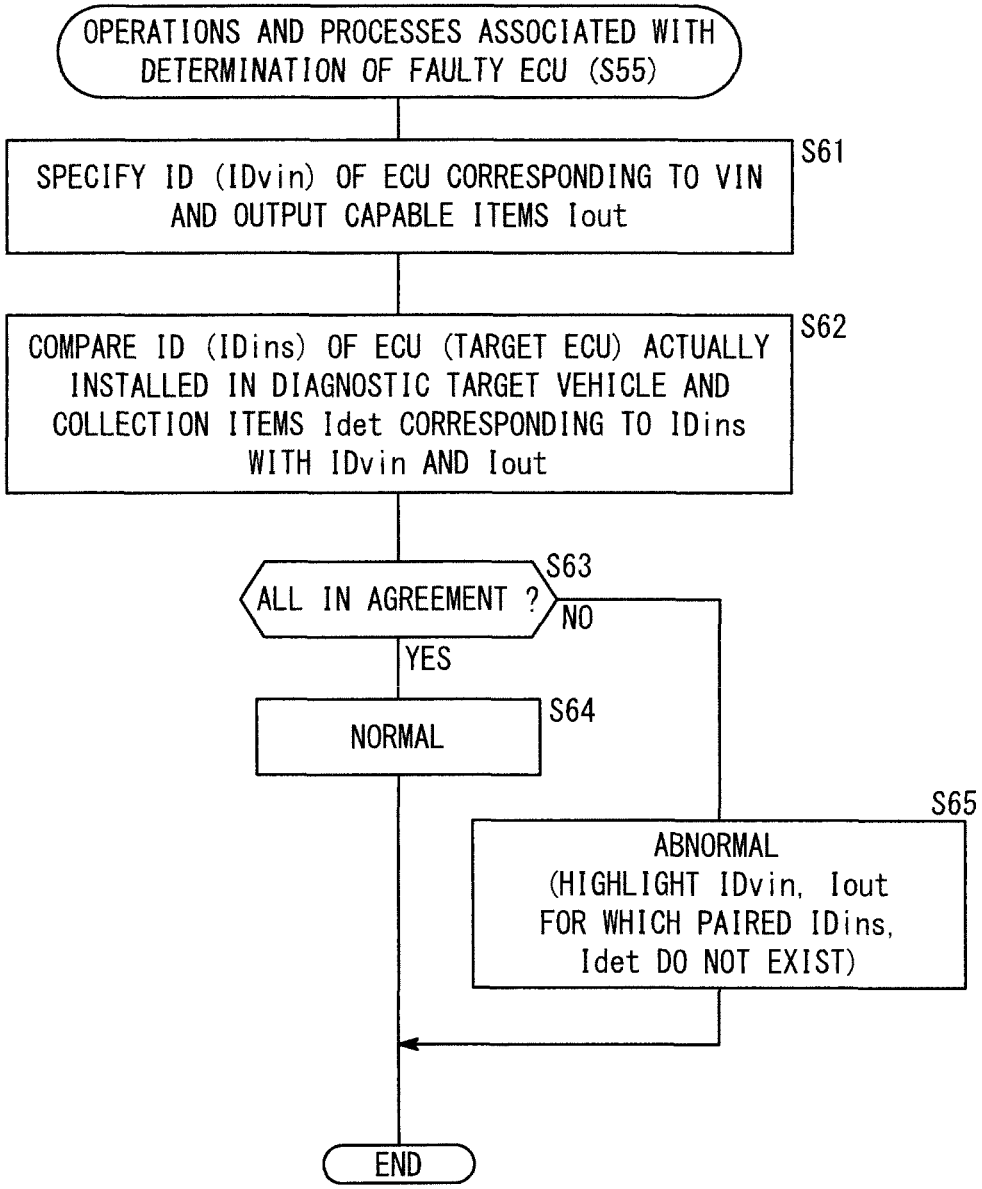
FIG. 12 is a flowchart of operations performed by the operator and processes of the diagnostic machine main body associated with determination of a faulty ECU in the aforementioned embodiment.

FIG. 12 is a flowchart of operations performed by an operator and processes of the diagnostic machine main body 16 associated with determination of a faulty ECU 20mal. The process of the diagnostic machine main body 16 shown in FIG. 12 is executed by the computation unit 52. In step S61, when the operator issues a command to start diagnosis, the main body 16 specifies the ID (IDvin) and the output capable items Iout of the ECU 20 (i.e., the target ECU 20tar), which corresponds to the VIN acquired during collection of the data D.

In step S62, the diagnostic machine main body 16 compares the IDins that the data collecting apparatus 18 has acquired from the vehicle 12 (step S4 of FIG. 3) and the collection items Idet based thereon (step S5), and the IDvin corresponding to the VIN and the output capable items Iout based thereon (step S7) with each other (refer to FIG. 4).

If all of the IDins and the collection items Idet match with all of the IDvin and the output capable items Iout (step S63: YES), then in step S64, the main body 16 judges that the concerned target ECU 20tar is normal, and displays a normal state.

If a portion of the IDins does not match with the IDvin, or if a portion of the collection items Idet does not match with the output capable items Iout (step S63: NO), then in step S65, the main body 16 judges that the concerned target ECU 20tar is abnormal. In this case, an IDvin for which a paired IDins does not exist, or an output capable item Iout for which a paired collection item Idet does not exist, is highlighted on the screen 300.

[4. Advantages of the Present Embodiment]

In the foregoing manner, according to the present embodiment, since the data collecting apparatus 18 carries out at least part of the settings for the collection items Idet (step S5 of FIG. 3, step S44 of FIG. 9), it is possible to reduce the effort (work load) of the operator associated with setting of the collection items Idet. Further, the installed ECU 20ins that is notified from the vehicle 12 is identified as the target ECU 20tar (step S4 of FIG. 3, step S42 of FIG. 9), and the output capable items Iout corresponding to the target ECU 20tar is set as the collection items Idet (step S5 of FIG. 3, step S44 of FIG. 9). Therefore, it is possible to prevent human error of the operator associated with setting of the collection items Idet.

In the present embodiment, in response to an initial on operation (step S23 of FIG. 8: YES) of the IGSW (starting switch) in a state in which the data collecting apparatus 18 is connected to the vehicle 12, the request signal specifying function 108 (collection item setting unit) of the data collecting apparatus 18 queries the vehicle 12 as to whether or not an installed ECU 20ins exists for each ECU type Cecu (type of target ECU 20tar) set by the diagnostic machine main body 16 (type setting unit) (step S24 of FIG. 8, step S42 of FIG. 9), and sets the collection items Idet (step S5 of FIG. 3, step S44 of FIG. 9). Furthermore, if the IGSW 40 is turned off and thereafter turned on again (step S26 of FIG. 8: YES→step S28: YES), the data requesting function 110 and the data receiving and storing function 112 (data collecting manager) of the data collecting apparatus 18 initiates transmission of the data request signal Sreq and storage of the data D.

According to the above feature, as understood from FIGS. 8 and 9, at least part of the settings of the collection items Idet and starting collection of the driving parameter data D can be carried out by connection of the data collecting apparatus 18 with respect to the in-vehicle network 34*a*, 34*b*, and by operation of the IGSW 40 (starting switch). Consequently, with a simple operation, the operator can perform at least part of the settings for the collection items Idet and starting collection of the driving parameter data D.

In the present embodiment, if the connection of the data collecting apparatus 18 with respect to the in-vehicle network 34*a*, 34*b* has been released once (step S31 of FIG. 8: YES), then in response to an initial on operation of the IGSW 40 (step S23: YES) after the data collecting apparatus 18 has been connected to a new in-vehicle network 34*a*, 34*b* (step S21), a new target ECU 20tar is set (step S24 of FIG. 8, step S42 of FIG. 9). This is followed by the request signal specifying function 108 (collection item setting unit) setting new collection items Idet (step S24 of FIG. 8, step S44 of FIG. 9).

According to this feature, the diagnostic target vehicle 12tar can easily be changed, simply by detaching the data collecting apparatus 18 from one vehicle 12 (first vehicle) and attaching it to another vehicle 12 (second vehicle).

In the present embodiment, connection of the data collecting apparatus 18 and the in-vehicle network 34*a*, 34*b* is carried out through connection of the connector 94 of the data collecting apparatus 18 and the data link connector 38 of the vehicle 12 (see, FIG. 1). Further, the data collecting apparatus 18 is activated by supply of power from the battery 24 (vehicle-mounted power supply) through the connector 94 and the data link connector 38 (step S22 of FIG. 8).

According to this feature, the activation timing of the data collecting apparatus 18 can be made to coincide with the time of connection to the data link connector 38. Consequently, restarting of the data collecting apparatus 18 can be carried out by detaching and thereafter attaching the connector 94 with respect to the data link connector 38 for the purpose of changing the diagnostic target vehicle 12tar, and it is possible to easily operate the data collecting apparatus 18 after the diagnostic target vehicle 12tar has been changed.

In the present embodiment, the diagnostic machine main body 16 (type setting unit) sets the ECU types Cecu, which are classified based on the type of vehicle 12 in relation to the drive source thereof, responsive to an input from the operator (step S1 of FIG. 3, and FIG. 7). The ECU types Cecu which are classified based on the type of vehicles 12 in relation to the drive sources thereof refer to types in which plural vehicle types are integrated, and in which the ECUs 20 that are installed in each vehicle type are classified based on the type of function thereof.

It is possible for the operator to easily determine the type Cv of the vehicle 12 in relation to the drive source (gasoline vehicle, diesel vehicle, hybrid vehicle, etc.). On the other hand, the items of driving parameter data D differ significantly depending on the type Cv of the vehicle 12. According to the present embodiment, the operator (user) specifies the vehicle type Cv, whereupon the data collecting apparatus 18 uses the collection items candidates Iop included within a range that depends on the type Cv designated by the operator (steps S1, S2, S4, S5 of FIG. 3). According to this feature, while achieving a reduction in the input burden by the operator or preventing input errors, the computational load in the data collecting apparatus 18 and the effort or number of steps imposed on the operator can be reduced.

According to the present embodiment, with respect to output capable items Iout (collection scheduled items Iex) possessed by an installed ECU 20ins that corresponds to the VIN, in the case that a missing item for which the driving parameter data D are not collected exists within the collection items Idet that have actually been collected (step S63: NO in FIG. 12), it is determined that there is a possibility for occurrence of a fault concerning the missing item (step S65). Consequently, a site that has the possibility of generating a fault (faulty ECU 20mal: communications error in ECU 20 corresponding to the missing item) can easily be specified.

Further, the collection scheduled items Iex are first specified (or limited) based on the VIN (step S61 of FIG. 12), and then are compared with the collection items Idet (step S62). Therefore, the scope of the collection scheduled items Iex that are to be compared with the collection items Idet can be narrowed, and thus it is possible to reduce the processing load of the diagnostic machine main body 16 (diagnostic device) as well as the effort of the operator associated therewith.

B. Modifications

It is a matter of course that the present invention is not limited to the embodiment described above, and various alternative or additional structures can be adopted therein based on the descriptive content of the present specification. For example, the present invention may employ the following arrangements.

[1. Objects to which the Invention is Applicable]

In the above embodiment, the external diagnostic machine 14 is used in the vehicle 12. However, the present invention is not limited in the above, and the external diagnostic machine 14 may be used with a stand-alone apparatus (e.g., a mobile body such as a ship, an aircraft, or the like, or any of various manufacturing apparatus) having a local network to which a plurality of ECUs 20 are connected.

[2. Vehicle 12]

In the above embodiment, a CAN is used as the in-vehicle network 34*a*, 34*b*. However, the present invention is not limited to the above, and a network such as LIN, FlexRay, K-line, or the like may be used.

In the above embodiment, a description was given based on the premise that the IGSW 40 is a rotary switch. However, the IGSW 40 may be a switch, such as a push type switch or the like, which is provided in the diagnostic target vehicle 12tar in which data is actually collected. Moreover, although the IGSW 40 implies an ignition switch in a narrow sense, which is used in a vehicle 12 having an engine, the IGSW 40 may refer to a starting switch for the vehicle 12, and the same method can be used even if the vehicle 12 is an EV (electric vehicle).

[3. External Diagnostic Machine 14]

(3-1. Diagnostic Purpose)

In the above embodiment, the external diagnostic machine 14 performs a fault diagnosis on the vehicle 12. However, from the standpoint that the data collecting apparatus 18 collects driving parameter data D, the external diagnostic machine 14 may make other vehicle diagnoses. For example, the external diagnostic machine 14 may perform a checkup for confirming a deteriorated or operating state of each vehicle-installed device, or a driving skill diagnosis for diagnosing drivers for driving skills (e.g., an accelerating action, a braking action). Therefore, the driving parameter data D needn't necessarily be limited to data used for a fault diagnosis, but may be data used for other diagnoses.

(3-2. Diagnostic Machine Main Body 16)

In the above embodiment, the diagnostic machine main body 16 may comprise a commercially available laptop personal computer, tablet computer, or smart phone, for example, and may be constructed as a single unit. However, the diagnostic machine main body 16 is not limited to such devices. For example, the main body 16 may comprise a personal computer as a main apparatus, and a slave unit (repeater) as an interface for connection to the data collecting apparatus 18.

In the above embodiment, the diagnostic software used by the diagnostic machine main body 16 is prerecorded in the storage unit 54. However, the invention is not limited to this feature. For example, the diagnostic software may be downloaded from an external source, e.g., an external server that can be accessed through a public network, or may be executed using a download-free ASP (Application Service Provider).

(3-3. Data Collecting Apparatus 18)

(3-3-1. Configuration)

In the above embodiment, the data collecting apparatus 18 is separate from the diagnostic machine main body 16 (FIG. 1). However, the main body 16 may possess and perform the functions of the data collecting apparatus 18.

In the above embodiment, the diagnostic machine main body 16 and the data collecting apparatus 18 communicate with each other via a wired communications link, and the vehicle 12 and the data collecting apparatus communicate with each other via a wired communications link (FIG. 1). However, a wireless communications link may be used for communications between some of these devices. For example, the diagnostic machine main body 16 and the data collecting apparatus 18 may communicate with each other via a wireless communications link. Alternatively, a wireless communications unit (not shown), which is connected to the in-vehicle network 34*a*, 34*b*, may be disposed in the vehicle 12. In this case, the data collecting apparatus 18 can carry out wireless communications with the wireless communications unit, and the data collecting apparatus 18 can communicate with each of the ECUs 20 through the wireless communications unit.

(3-3-2. Starting Conditions)

In the above embodiment, the data collecting apparatus 18 is started automatically upon connection of the connector 94 to the data link connector 38 (step S22 of FIG. 8). However, for example, from the standpoint of starting the data collecting apparatus 18, the invention is not limited to this feature. For example, a configuration may be provided in which a non-illustrated starting switch is provided on the data collecting apparatus 18, and the data collecting apparatus 18 is turned on by the operator operating the starting switch. Further, a power source, which is capable of operating the data collecting apparatus over a prolonged time period, may be provided in the data collecting apparatus 18 itself.

(3-3-3. Data Collecting Conditions)

In the above embodiment, as a condition for starting collection of the data D (step S29 of FIG. 8), turning on and off the IGSW 40 and then turning on the IGSW again is used (steps S23, S26, S28). However, for example, from the standpoint of confirming the output capable items Iout and setting the collection items Idet, the invention is not limited to this feature. For example, the starting condition for collection of the data D can be to move the position of the IGSW 40 to accessory (ACC) after the IGSW 40 has been turned on and off. More specifically, among the ECUs 20, cases exist in which the ECUs 20 are started up when the IGSW 40 is placed in the on position, and other cases exist in which the ECUs 20 are started up when the IGSW 40 is placed in the ACC position. Thus, starting per se of data collection may be initiated when the position of the IGSW 40 has been moved from off to the ACC position.

What is claimed is:

1. A vehicle diagnostic data collecting apparatus in which, in a state of being connected detachably from exterior to an in-vehicle network having a plurality of electronic control units, a data request signal for requesting driving parameter data indicative of operating states of respective components of a vehicle is transmitted to at least one target electronic control unit of the plurality of electronic control units, and the driving parameter data corresponding to the data request signal is received and stored in a data storage unit, the data collecting apparatus comprising:

a type setting unit configured to set a type of electronic control unit;

the data item storage unit configured to store items of the driving parameter data in association with identifying information of the plurality of electronic control units, the driving parameter data items being capable of being output by each of the plurality of electronic control units;

a collection item setting unit configured to query a vehicle as to whether or not an identified electronic control unit is installed as an installed electronic control unit, to identify, when the identified electronic control unit is determined to be installed, the installed electronic control unit as a target electronic control unit for each type of target electronic control unit set by the type setting unit, to read out the driving parameter data items capable of being output by the installed electronic control unit that was identified as the target electronic control unit from the data item storage unit based on identifying information of the installed electronic control unit, and to set the driving parameter data items as collection items; and a data collecting manager configured to transmit to the target electronic control unit the data request signal for requesting the driving parameter data corresponding to the collection items, and to receive and store in the data storage unit the driving parameter data corresponding to the data request signal.

2. The data collecting apparatus according to claim 1, wherein:

the collection item setting unit is configured to send the query in response to an initial on operation of a starting switch in a state in which the data collecting apparatus is connected to the vehicle; and subsequently, when the starting switch is turned off and thereafter turned on again, the data collecting manager initiates transmission of the data request signal and storage of the driving parameter data.

3. The data collecting apparatus according to claim 2, wherein, when connection of the data collecting apparatus with respect to the in-vehicle network has been released once, then responsive to an initial on operation of the starting switch after the data collecting apparatus has been connected to a new in-vehicle network, the new in-vehicle network is queried as to whether or not the installed electronic control unit still exists for each type of target electronic control unit set by the type setting unit, and new collection items are set.

4. The data collecting apparatus according to claim 1, wherein:

the connection between the data collecting apparatus and the in-vehicle network is carried out through a data link connector of the vehicle; and the data collecting apparatus is started by supply of electric power thereto from a vehicle-mounted power supply through the data link connector.

5. The data collecting apparatus according to claim 1, wherein the type setting unit is configured to integrate a plurality of vehicle types, and to classify the electronic control units that are installed in each vehicle type based on a type of function of each of the electronic control units.

6. A vehicle diagnostic data collecting method using a data collecting apparatus in which, in a state of being connected detachably from exterior to an in-vehicle network having a plurality of electronic control units, a data request signal for requesting driving parameter data indicative of operating states of respective components of a vehicle is transmitted to at least one target electronic control unit of the plurality of electronic control units, and the driving parameter data corresponding to the data request signal is received and stored in a storage unit, wherein the data collecting apparatus performs:

a type setting process for setting a type of electronic control unit;

the storing process for storing, in the storage unit, items of the driving parameter data in association with identifying information of the plurality of electronic control units, the driving parameter data items being capable of being output by each of the plurality of electronic control units;

a collection item setting process for querying a vehicle as to whether or not an identified electronic control unit is installed, identifying, when the identified electronic control unit is determined to be installed, the installed electronic control unit as a target electronic control unit for each type of target electronic control unit set by the type setting process, reading out the driving parameter data items capable of being output by the installed electronic control unit that was identified as the target electronic control unit, from the storage unit based on identifying information of the installed electronic control unit, and setting the driving parameter data items as collection items; and a data collecting process for transmitting to the target electronic control unit the data request signal for requesting the driving parameter data corresponding to the collection items, and receiving and storing in the storage unit the driving parameter data corresponding to the data request signal.

* * * * *